US011364721B2

(12) United States Patent
Leiser et al.

(10) Patent No.: US 11,364,721 B2
(45) Date of Patent: Jun. 21, 2022

(54) PRINT LIQUID SUPPLY INTERCONNECT IN HOSE-FED HOUSING

(71) Applicant: Hewlett-Packard Development Company, L.P., Spring, TX (US)

(72) Inventors: Judson M. Leiser, Corvallis, OR (US); Miquel Boleda Busquets, Sant Cugat del Vallès (ES); Steven T. Castle, Corvallis, OR (US); David Olsen, Corvallis, OR (US)

( * ) Notice: Subject to any disclaimer, the term of this patent is extended or adjusted under 35 U.S.C. 154(b) by 94 days.

(21) Appl. No.: 16/763,850

(22) PCT Filed: Jul. 13, 2018

(86) PCT No.: PCT/US2018/041986

§ 371 (c)(1),
(2) Date: May 13, 2020

(87) PCT Pub. No.: WO2020/013848

PCT Pub. Date: Jan. 16, 2020

(65) Prior Publication Data

US 2020/0282734 A1 Sep. 10, 2020

(51) Int. Cl.
*B41J 2/175* (2006.01)

(52) U.S. Cl.
CPC ..... *B41J 2/17526* (2013.01)

(58) Field of Classification Search
CPC ..... B41J 2/175; B41J 2/17513; B41J 2/1752; B41J 2/17523; B41J 2/17526; B41J 2/1753; B41J 2/17546; B41J 2/1755; B41J 2/17553
USPC ..... 347/20, 84–87, 108
See application file for complete search history.

(56) References Cited

U.S. PATENT DOCUMENTS

| | | | |
|---|---|---|---|
| 6,033,064 | A | 3/2000 | Pawlowski, Jr |
| 6,443,567 | B1 | 9/2002 | Hayashi et al. |
| 6,488,369 | B1 | 12/2002 | Steinmetz et al. |
| 6,863,388 | B2 | 3/2005 | Seino et al. |

(Continued)

FOREIGN PATENT DOCUMENTS

| | | |
|---|---|---|
| CN | 1799846 | 7/2006 |
| CN | 1919614 | 2/2007 |

(Continued)

*Primary Examiner* — Hoan H Tran
(74) *Attorney, Agent, or Firm* — Hanley Flight & Zimmerman LLC

(57) ABSTRACT

In one example in accordance with the present disclosure, at least one print liquid supply interconnected is described. Each print liquid supply interconnect includes a housing movable relative to a printer and tethered via a feed hose to the printer. The housing includes at least one needle to be inserted in a print liquid supply to allow print liquid to move between the print liquid supply and an ejection device and two keyed slots disposed on either side of a first needle to gate insertion to a print liquid supply with protrusions that match the two keyed slots. The housing also includes a guide feature adjacent the first needle extending between a first keyed slot and the first needle and an electrical interface to establish a data transmission path between the print liquid supply and the ejection device, the electrical interface disposed between the first needle and a second keyed slot.

22 Claims, 18 Drawing Sheets

(56) References Cited

U.S. PATENT DOCUMENTS

| | | | | |
|---|---|---|---|---|
| 7,255,430 | B2 * | 8/2007 | Silverbrook | B41J 2/04591 347/85 |
| 7,258,431 | B2 | 8/2007 | Shinada et al. | |
| 7,654,655 | B2 | 2/2010 | Malik et al. | |
| 8,602,536 | B1 * | 12/2013 | Sarnoff | B41J 2/17506 347/85 |
| 8,636,345 | B2 | 1/2014 | Ogle et al. | |
| 8,727,516 | B2 * | 5/2014 | Harvey | B41J 2/17553 347/86 |
| 9,067,424 | B1 | 6/2015 | Tominaga et al. | |
| 9,248,656 | B2 | 2/2016 | Nozawa et al. | |
| 9,522,776 | B2 | 12/2016 | Kawate | |
| 9,533,510 | B2 | 1/2017 | Begeal et al. | |
| 2002/0109761 | A1 | 8/2002 | Shimizu et al. | |
| 2005/0036015 | A1 | 2/2005 | Seino | |
| 2018/0043695 | A1 | 2/2018 | Kawate | |

FOREIGN PATENT DOCUMENTS

| | | | |
|---|---|---|---|
| EP | 1470923 | B1 | 8/2007 |
| EP | 1815994 | A2 | 8/2007 |
| EP | 2258554 | B1 | 4/2015 |
| EP | 3118002 | A4 | 3/2018 |
| EP | 3300904 | A1 | 4/2018 |
| JP | S63276554 | | 11/1988 |
| WO | WO-2018022037 | A1 | 2/2018 |

* cited by examiner

PRINT LIQUID SUPPLY INTERCONNECT IN HOSE-FED HOUSING

RELATED APPLICATIONS

This patent arises from the U.S. national stage of International Patent Application Serial No. PCT/US18/041986, having a filing date of Jul. 13, 2018. International Patent Application Serial No. PCT/US18/041986 is hereby incorporated by reference in its entirety.

BACKGROUND

Ejection devices operate to dispense a liquid onto a substrate surface. For example, a printer may operate to dispense print liquid such as ink onto a surface such as paper in a predetermined pattern. In another example, an additive manufacturing liquid is dispensed as part of an additive manufacturing operation. The print liquid is supplied to such ejection devices from a reservoir or other supply. That is, a print liquid supply reservoir holds a volume of print liquid that is passed to the fluidic ejection device and ultimately deposited on a surface. In some examples, the print liquid supplies are a separate component, i.e., removable, from the ejection device.

BRIEF DESCRIPTION OF THE DRAWINGS

The accompanying drawings illustrate various examples of the principles described herein and are part of the specification. The illustrated examples are provided for illustration, and do not limit the scope of the claims.

Figure 1:
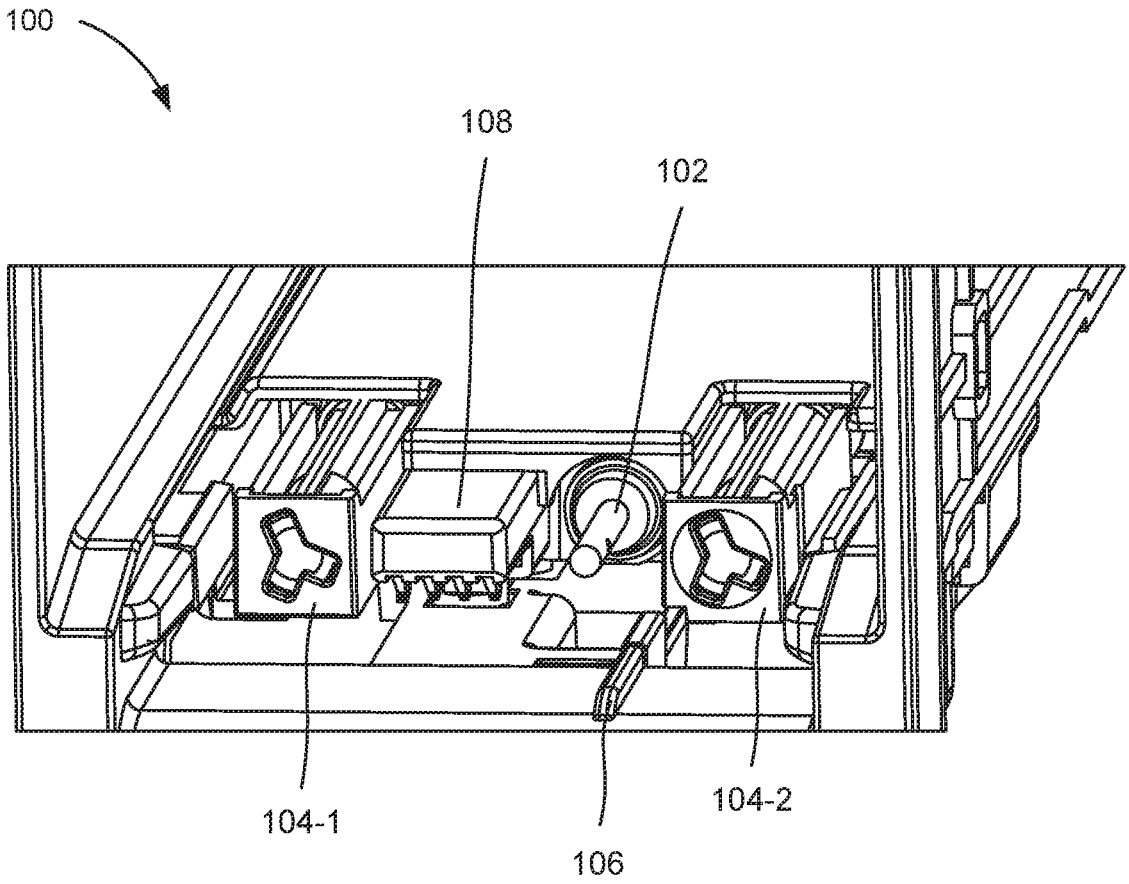
FIG. 1 is a diagram of a print liquid supply interconnect with keyed slots, according to an example of the principles described herein.

Throughout the drawings, identical reference numbers designate similar, but not necessarily identical, elements. The figures are not necessarily to scale, and the size of some parts may be exaggerated to more clearly illustrate the example shown. Moreover, the drawings provide examples and/or implementations consistent with the description; however, the description is not limited to the examples and/or implementations provided in the drawings.

DETAILED DESCRIPTION

As described above, liquid such as print liquid in a printer and an additive manufacturing liquid in a 3D printer, is supplied to an ejection device from liquid supplies. Such supplies come in many forms. For example, one such supply includes a pliable reservoir. Pliable reservoirs are advantageous for the simplicity with which they are made and their low cost. However, pliable reservoirs themselves are difficult to handle and couple to an ejection device. For example, it may be difficult for a user to physically manipulate a pliable reservoir into place within a printer.

Before the ejection device can eject the liquid, a fluidic connection is established between the print liquid supply and the ejection device. Accordingly, the present specification describes an interconnect for a print liquid supply. The interconnect receives the print liquid supply and includes at least one needle to be inserted into the print liquid supply. Two keyed slots are disposed on either side of a first needle. A print liquid supply includes protrusions of a particular shape. If the shape of the protrusion matches the keyed slot shape, the protrusions pass through the keyed slots and push actuators that retract a plate. The plate initially protects the needles as well as an electrical interface. The retraction of the plate exposes the needles and electrical interface such that they may interface with corresponding components on the print liquid supply. By comparison, if the protrusions do not match the keyed slots, then the protrusions cannot reach the actuators and therefore the print liquid supply cannot be further inserted and the retractable plate does not uncover the needles and electrical interface.

Specifically, the present specification describes at least one print liquid supply interconnect. Each interconnect includes a housing movable relative to a printer and tethered via a feed hose to the printer. The housing includes at least one needle to be inserted into a print liquid supply to allow print liquid to move between the print liquid supply and an ejection device. The housing also includes two keyed slots disposed on either side of the first needle. The keyed slots gate insertion to a print liquid supply with protrusions that match the two keyed slots. A guide feature of the interconnect is adjacent the first needle and extends between a first keyed slot and the first needle. An electrical interface of the interconnect establishes a data transmission path between the print liquid supply and the ejection device, the electrical interface is disposed between the first needle and a second keyed slot.

In any example the housing is coupled to an end of a feed hose. In any example, the feed hose may be a flexible hose. In any example, the interconnect is separate from the printer.

In any example, the interconnect also includes an actuator, such as a rod, behind each keyed slot. In any example, the interconnect includes a retractable plate. The retractable plate, when a print liquid supply is not present, extends past the at least one needle and electrical interface to protect against mechanical damage. When a print liquid supply is inserted, the retractable plate retracts to expose the at least one needle to the print liquid supply and expose the electrical interface to a corresponding interface on the print liquid supply. In this example, the two keyed slots 1) allow matching protrusions to act upon the actuators and 2) prevent non-matching protrusions from acting upon the actuators.

In any example, the interconnect includes a latch assembly actuated by insertion of the protrusions in the two keyed slots. The latch assembly controls the movement of the retractable plate. In any example, the latch assembly includes 1) a wireform coupled to the actuators and the retractable plate to decouple the retractable plate from a base such that the retractable plate may move, 2) springs to bias the actuators and retractable plate to an extended position, 3) a plate latch guided in a first latch track to mechanically retain the retractable plate in a retracted position, and 4) a supply latch guided in a second latch track to mechanically retain the print liquid supply in place during operation.

In any example, the at least one needle, electrical interface, two keyed slots and guide feature extend from the same plane. In any example, multiple interconnects are part of the same printer, wherein each interconnect is associated with a different color and has keyed slots of different sizes or shapes.

The present specification also describes a printer. The printer includes an ejection device to deposit print liquid onto a substrate and a controller to control operation of the ejection device to deposit print liquid in a desired pattern. The printer also includes a print liquid supply interconnect as described above. In this example, in addition to the at least one needle, guide feature, electrical interface, and keyed slots, the print liquid supply interconnect includes a feed hose to fluidly couple the ejection device to a print liquid supply and an actuator behind each keyed slot and a retractable plate. The retractable plate 1) when a print liquid supply is not present, extends past the at least one needle and electrical interface to protect the at least one needle and electrical interface from mechanical damage and 2) when a print liquid supply is inserted, retracts to expose the at least one needle to the print liquid supply and expose the electrical interface to a corresponding interface on the print liquid supply. In this example, the two keyed slots 1) allow matching protrusions to act upon corresponding actuators and 2) prevent non-matching protrusions from acting upon corresponding actuators.

In any example, the interconnect is to couple to a print liquid supply that is not inserted into the printer and is expandable outside the printer. In any example, the two keyed slots are unique to a particular color of ink.

The present specification also describes a print liquid supply. The print liquid supply includes a reservoir to hold the print liquid and an interface to electrically and fluidly couple the print liquid supply to the printer. The interface includes protrusions to pass through keyed slots in a print liquid supply interconnect and to act upon actuators of the print liquid supply interconnect when passing through with corresponding keyed slots. In any example, the interface protrudes from the reservoir. In any example, the interface is a low-profile interface protruding from the reservoir over a distance that is ten time less than a total height of the reservoir. In any example, the interface has a width that is at least three times smaller than a total width of the reservoir. In any example, a cross-section of the protrusion matches the keyed slot. In any example, the reservoir has a maximum capacity of at least 3 liters of liquid.

In any example, the print liquid supply includes 1) an electrical interface extending between one of the protrusions and a liquid output to receive a fluidic needle approximately parallel to a wall of the reservoir from which the interface projects and 2) contact pads of the electrical interface, which contact pads extend along a line perpendicular to a needle insertion direction of the liquid output.

The present specification also describes an ejection system that includes the ejection device, controller, and print liquid supply interconnect as described above. The system also includes a print liquid supply. The print liquid supply includes a reservoir to hold the print liquid and an interface to electrically and fluidly couple the print liquid supply to the printer. The interface includes protrusions to pass through and match the keyed slots and to act upon the actuators when matched with corresponding keyed slots.

In any example, the print liquid is an additive manufacturing fabrication agent or an ink. In any example, the print liquid supply includes a collapsible reservoir disposed in a container.

In any example, the print liquid supply further includes a spout. The spout may include 1) a sleeve having an opening through which the print liquid pass, 2) a first flange extending outward from the sleeve to affix the spout to the collapsible reservoir, 3) a second flange extending outward from the sleeve to sit on a wall of the container, and 4) an angled clamp flange extending outward from the sleeve. The angled clamp flange having an angled surface and a straight surface opposite the angled surface, the angled clamp flange to affix the spout to the container.

In any example, the print liquid supply includes a clamp plate assembly. The clamp plate assembly includes a clamp plate having 1) two wedge-shaped forked ends to facilitate clamping a spout to a container in which a print liquid reservoir is disposed and 2) a slot defined by the forked ends to receive and retain the spout. The assembly also includes a back plate approximately orthogonal to the clamp plate.

In one example, the connection is established by sliding a print liquid supply into a port of a printer. In another example, the print liquid supply is stationary and a connection is established by manually moving a tethered, hose-fed interconnect into place on the print liquid supply.

When the interconnect is disposed in a port of the printer, the interconnect may be disposed near the opening. For example, some interfaces may be at an end of a port away from a customer. As bigger supplies may be longer, ports in the printer in which the supply is positioned may be deeper. If a customer is putting in a smaller supply into the port for a larger supply, he/she may be reaching far into the port to place the smaller supply, which is complex and may lead to a less than satisfactory customer experience.

When the interconnect is disposed on the end of a flexible hose additional benefits are achieved. For example, large supplies may be difficult to handle and can be weighty.

Loading such heavy supplies into a port can be difficult and even more so to align such supplies.

In some examples, this interconnect may be universal across different sizes of print liquid supplies. That is, rather than having different sizes of print liquid supplies that have different interfaces, the present specification describes an interface that is used on a wide variety of print liquid supply volumes.

In summary, such an interconnect 1) accommodates connection between a printer and any number of print liquid supplies with different volumes, 2) accommodates print liquid supplies that may be too large to be inserted into a printer, 3) provides for simple coupling of a print liquid supply to a printer, and 4) provides for a satisfactory customer experience.

As used in the present specification and in the appended claims, the term "print liquid supply" refers to a device that holds a print liquid. For example, the print liquid supply may be a pliable reservoir.

Accordingly, a print liquid supply container refers to a carton or other housing for the print liquid supply. For example, the print liquid supply container may be a cardboard box in which the pliable containment reservoir is disposed.

Still further, as used in the present specification and in the appended claims, the term "print liquid" refers to a liquid deposited by an ejection device and can include, for example, ink or an additive manufacturing fabrication agent. Still further, as used in the present specification and in the appended claims, the term "fabrication agent" refers to any number of agents that are deposited and includes for example a fusing agent, an inhibitor agent, a binding agent, a coloring agent, and/or a material delivery agent. A material delivery agent revers to a fluid carrier that includes suspended particles of at least one material used in the additive manufacturing process.

Turning now to the figures, FIG. 1 is a diagram of a print liquid supply interconnect (100) with keyed slots (104-1, 104-2), according to an example of the principles described herein. The print liquid supply interconnect (100) is a component of a printer. The interconnect (100) provides a mechanical, electrical, and fluidic connection between a print liquid supply and the ejection device that ejects the print liquid. To facilitate such a connection, the print liquid supply interconnect (100) includes multiple components.

Figure 2:
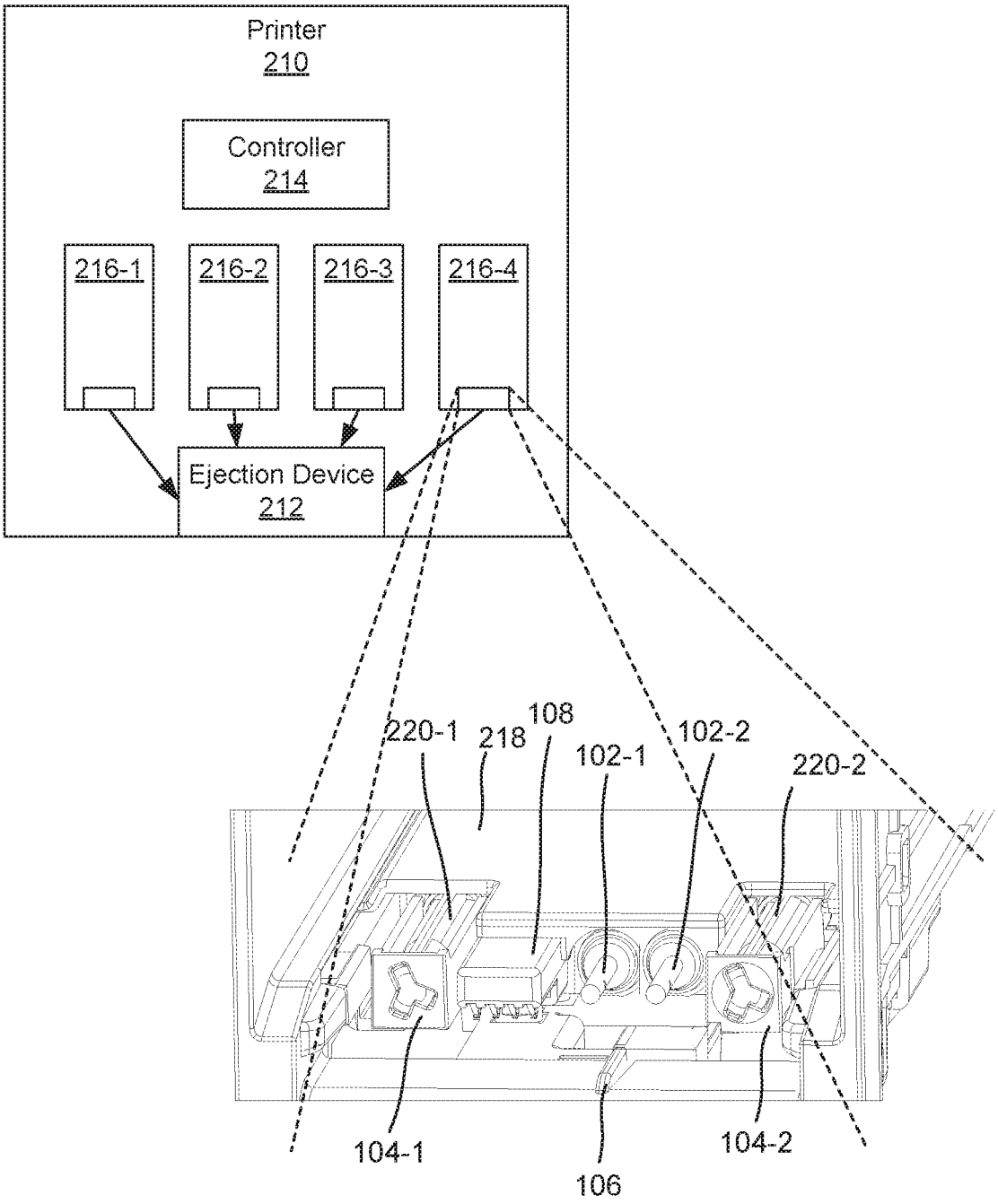
FIG. 2 is a diagram of a printer with an interconnect with keyed slots, according to an example of the principles described herein.

Specifically, the print liquid supply interconnect (100) includes at least one needle (102) to be inserted into a print liquid supply. In the example depicted in FIG. 1, a single needle (102) is used. However, as depicted in FIG. 2, in some example multiple needles (102) may be included. The needle (102) may be hollow and allow print liquid to pass there through. The print liquid may be drawn by any number of mechanisms. For example, gravity or a pump may operate to draw the print liquid from the print liquid supply, through the needle (102), and to the ejection device.

As mentioned above, the needle (102) may be inserted into the print liquid supply. For example, the needle (102) may pierce a septum on the print liquid supply and be put in fluidic communication with the supply. In another example, a valve or gasket may be present on the print liquid supply and the needle (102) may pass through the valve or gasket.

The print liquid supply interconnect (100) also includes at least two keyed slots (104-1, 104-2). The keyed slots (104) gate insertion of print liquid supplies into the interconnect (100). That is, a printer may have ports into which print liquid supplies are disposed. It may be desirable that certain types of liquid be inserted into particular ports. As a specific example, where the print liquid is ink, it may be desirable that certain colors of ink are disposed in certain ports. Accordingly, via the keyed slots (104) it may be ensured that just a desired print liquid supply is inserted into a particular port. That is, the keyed slots (104) may be unique to a particular type of liquid, such as a particular color and/or type of ink. A print liquid supply of that liquid type or color of ink may have protrusions that match the shape of the keyed slots (104). In this example, those similarly-shaped protrusions fit into the keyed slots (104) and can therefore interface with the interconnect. By comparison, if a user tries to insert a print liquid supply of a different type or a different color ink into that port, the protrusions would not pass through the keyed slots (104) and that different print liquid supply would not be insertable into that particular port. Put another way, the two keyed slots (104-1, 104-2) may be unique to a particular type of liquid, such as a unique color of ink. In one example, the keyed slots (104) are disposed on either side of the needle (102).

The print liquid supply interconnect (100) also includes a guide feature (106) to guide insertion of the print liquid supply into the port of the printer. Put another way, the guide feature (106) ensures the interface on the print liquid supply is aligned with the interconnect (100) on the printer. As described above, the interconnect (100) provides a number of different connections, both fluidic and electrical between the print liquid supply and the ejection system. To ensure accurate fluidic and electrical connections, the interconnect (100) is aligned with components on the print liquid supply. Without such a guide feature (106), such an alignment is made more difficult. The guide feature (106) may take any number of forms such as a protrusion that mates with a slot on the print liquid supply. In another example, the guide feature (106) may be a slot in which a protrusion on the print liquid supply mates. In some examples, the guide feature (106) extends between a first keyed slot (104-1) and a first needle (102). However, other orientations are also contemplated by the present specification.

The print liquid supply interconnect (100) also includes an electrical interface (108) to establish a data transmission path between the print liquid supply and the ejection device. Many different types of data may be transmitted via this connection. For example, information regarding a formulation of the ink, a level of fluid within the print liquid supply, etc. may be included on a chip of the print liquid supply. This information may be passed to the printer to verify the print liquid supply or to adjust the operation of fluidic ejection in order to optimize the fluidic ejection. In some examples, the electrical interface (108) is disposed between the first needle (102) and a second keyed slot (104-2) however, in other examples the electrical interface (108) may be otherwise oriented. While specific reference is made to particular pieces of information, additional pieces of data can also be transferred via the electrical interface (108). As depicted in FIG. 1, in some examples, the needle (102), electrical interface (108), keyed slots (104-1, 104-2) and guide feature (106) extend from the same plane.

FIG. 2 is a diagram of a printer (210) with an interconnect (100) with keyed slots (104), according to an example of the principles described herein. As described above, an ejection device (212) operates to eject fluid onto a substrate. The ejection device (212) may operate based on any number of principles. For example, the ejection device (212) may be a firing resistor. The firing resistor heats up in response to an applied voltage. As the firing resistor heats up, a portion of the fluid in an ejection chamber vaporizes to generate a bubble. This bubble pushes fluid out an opening of the fluid chamber and onto a print medium. As the vaporized fluid bubble collapses, fluid is drawn into the ejection chamber from a passage that connects the ejection chamber to a fluid feed slot, and the process repeats. In this example, the ejection device (212) may be a thermal inkjet (TIJ) device.

In another example, the ejection device (212) may be a piezoelectric device. As a voltage is applied, the piezoelectric device changes shape which generates a pressure pulse in the fluid chamber that pushes the fluid through the chamber. In this example, the ejection device (212) may be a piezoelectric inkjet (PIJ) device.

Such an ejection device (212) may be included in a printer (210) that carries out at least liquid ejection. The printer (210) may include a controller (214) to control operation of the ejection device (212) to deposit the print liquid in a desired pattern. That is, the controller (214) may control the firing of individual ejectors within the ejection device (212) such that a predetermined pattern is formed.

The printer (210) may be any type of printer (210). For example, the printer (210) may be a 2D printer to form images on a two-dimensional substrate. In another example, the printer (210) may be a 3D printer, sometimes referred to as an additive manufacturing device. In an additive manufacturing process, a layer of build material may be formed in a build area. A fusing agent may be selectively distributed on the layer of build material in a pattern of a layer of a three-dimensional object. An energy source may temporarily apply energy to the layer of build material. The energy can be absorbed selectively into patterned areas formed by the fusing agent and blank areas that have no fusing agent, which leads to the components to selectively fuse together.

Additional layers may be formed and the operations described above may be performed for each layer to thereby generate a three-dimensional object. Sequentially layering and fusing portions of layers of build material on top of previous layers may facilitate generation of the three-dimensional object. The layer-by-layer formation of a three-dimensional object may be referred to as a layer-wise additive manufacturing process. In this example, the print liquid provided in a supply, and passing through to the ejection device (212) is an additive manufacturing fabrication agent.

As described above, the printer (210) may include any number of ports (216) to receive different print liquid supplies. While FIG. 2 depicts four ports (216-1, 216-2, 216-3, 216-4), the printer (210) may include any number of ports (216). For example, the printer (210) may include 10 ports (216). Each port (216) may accommodate different size print liquid supplies so long as the print liquid supply has a predetermined face shape. For example, the ports (216) may have an aspect ratio of at least 1.5. In this example, each print liquid supply that is inserted may have a similar aspect ratio to match the opening, and increase in volume may be provided by differences in length of the print liquid supplies.

Figure 4:
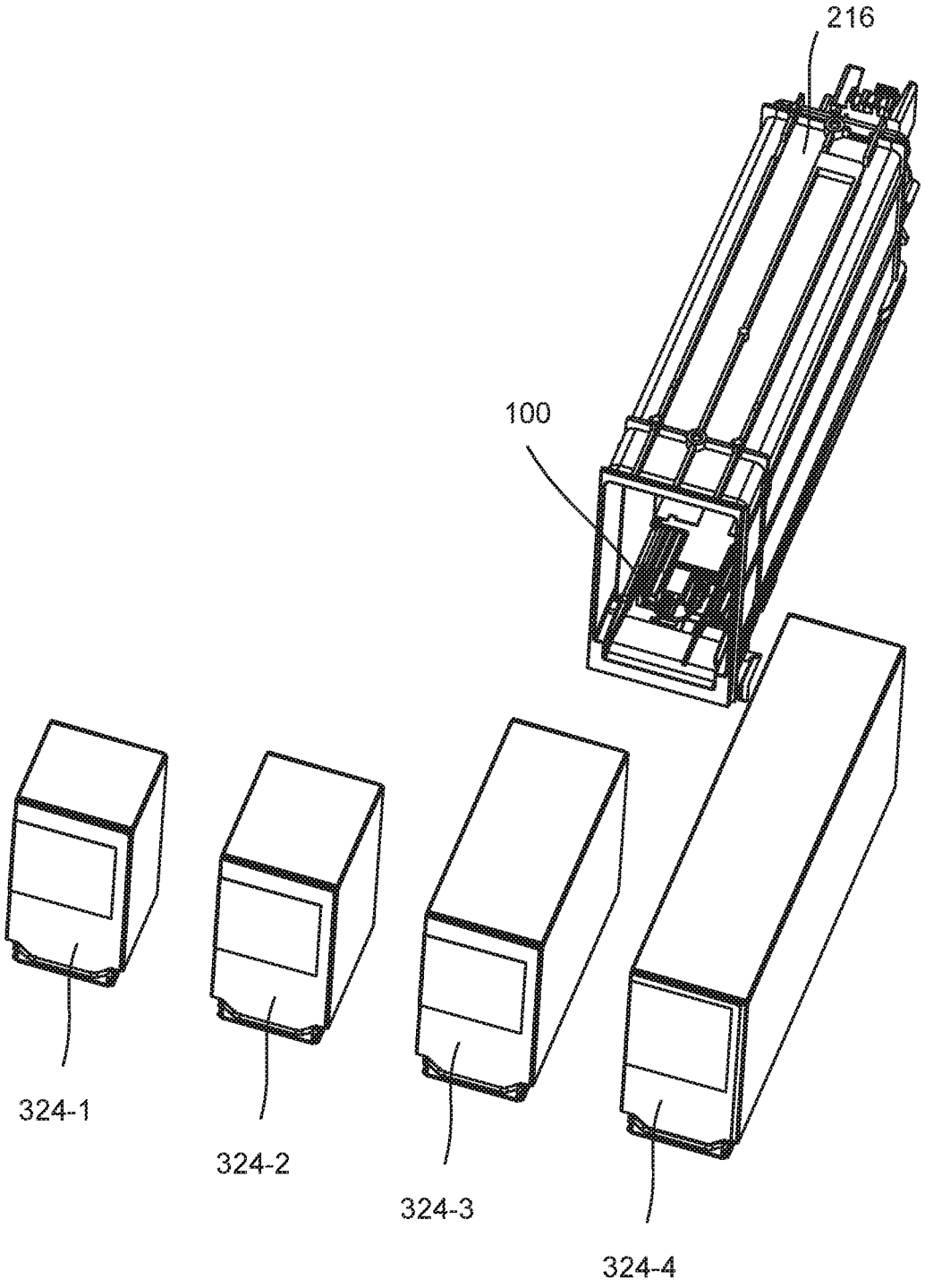
FIG. 4 is an isometric view of an interconnect with keyed slots and multiple print liquid supplies, according to an example of the principles described herein.

A print liquid supply interconnect (100) is provided in each port (216). FIG. 4 below depicts an example of the specific location of an interconnect (100) within a particular port (216). As described above, each print liquid supply interconnect (100) includes at least one needle (102) to be inserted into a print liquid supply to facilitate drawing the print liquid from the supply. In some examples, as depicted in FIG. 2, multiple needles (102-1, 102-2) may be present with one needle (102-1) drawing fluid into the printer (210) from the print liquid supply and another needle (102-2) drawing fluid from the printer (210) into the print liquid supply, thus forming an ink recirculation pattern.

The print liquid supply interconnect (100) also includes the keyed slots (104-1, 104-2), guide feature (106), and electrical interface (108) as described above in connection with FIG. 1.

In this example, the print liquid supply also includes a retractable plate (218). The retractable plate (218) has two positions, a retracted position and an extended position. The retractable plate (218) may be in the extended position when the port (216) is empty, that is when a print liquid supply is not disposed therein. In the extended position, that is when a print liquid supply is not present, the retractable plate (218) extends past the needles (102) and the electrical interface (108) to protect them. That is, the needles (102) may be fragile components as may the circuitry that makes up the electrical interface (108). Accordingly, the retractable plate (218) may extend past these components to prevent any mechanical force from damaging these components.

In a retracted position, that is when a print liquid supply is inserted, the retractable plate (218) retracts to 1) expose any needle (102) to the print liquid supply and 2) expose the electrical interface (108) to a corresponding interface on the print liquid supply. In some examples, 1) the retraction of the retractable plate (218), 2) insertion of a needle (102) into the print liquid supply, and 3) interface of the electrical interface (108) with an interface on the print liquid supply occur simultaneously.

In this example, the print liquid supply interconnect (100) includes an actuator (220) disposed behind each keyed slot (104). That is, a first actuator (220-1) is disposed behind a first keyed slot (104-1) and a second actuator (220-2) is disposed behind a second keyed slot (104-2). In any example, the actuators (220) may be rods. The actuators (220) are mechanically coupled to the retractable plate (218). When acted upon by protrusions on the print liquid supply, the actuators (220) retract the retractable plate (218). For example, protrusions on the print liquid supply may have a particular shape. If that shape matches the keyed slots (104) the protrusions pass through the keyed slots (104). Once through the keyed slots (104), those protrusions push on the actuators (220) which pushing causes the actuators (220) to move the retractable plate (218). Accordingly, during insertion of a print liquid supply, these actuators (220) move the retractable plate (218) to a retracted position such that the needles (102) and the electrical interface (108) are exposed to the print liquid supply and corresponding electrical interface on the print liquid supply that are approaching.

Put another way, the keyed slots (104) allow protrusions that match the keyed slots (104) to act upon the actuators (220) while preventing protrusions that do not match the keyed slots (104) from acting upon the actuators (220).

As depicted in FIG. 2, the printer (208) may include multiple ports (216) and therefore multiple interconnects (100). In this example, each interconnect (100) is associated with a different color of ink and/or different type of liquid. That is, each interconnect (100) may have keyed slots (104) with different shapes. Accordingly, just a print liquid supply with the same shaped protrusions may be inserted. Print liquid supplies pertaining to a certain color and/or a certain liquid type may have a certain protrusion shape, which may mate with keyed slots (104) of a particular port (216) such that 1) just that color/type can be inserted into that slot, and such that this color/type cannot be inserted into any other port (216).

Figure 3:
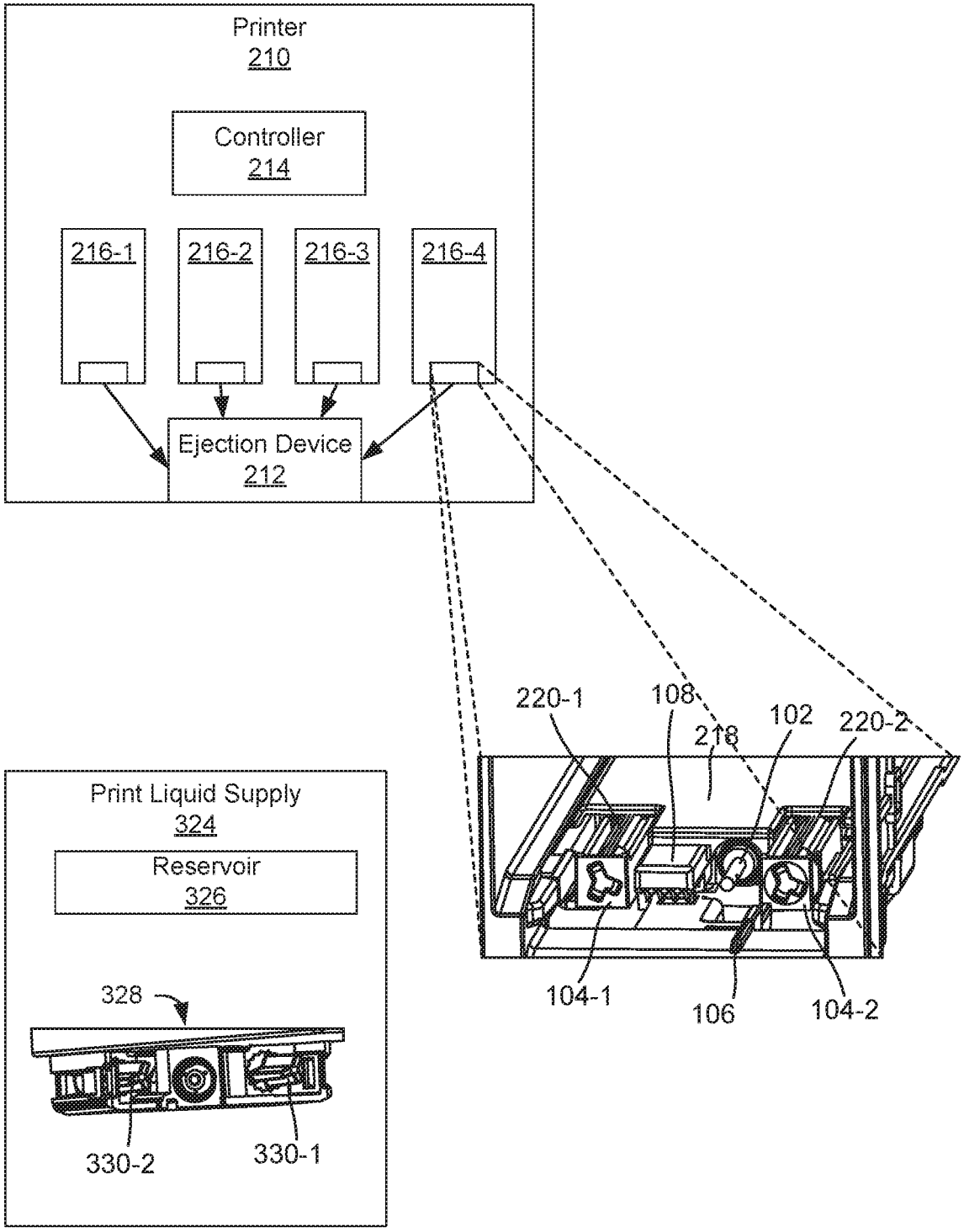
FIG. 3 is a diagram of a print liquid ejection system with an interconnect with keyed slots, according to another example of the principles described herein.

FIG. 3 is a diagram of a print liquid ejection system with an interconnect (100) with keyed slots (104-1, 104-2), according to another example of the principles described herein. The print liquid ejection system includes the printer (210) and print liquid supply interconnect (100) as described above. The print liquid ejection system also includes a print liquid supply (324). The print liquid supply (324) includes a reservoir (326) to hold the print liquid. As described above, the reservoir (326) may hold different types of liquid. For example, in 2D printing, the printing liquid may be ink. In another example such as 3D printing, the printing liquid may be an additive manufacturing agent such as a fusing agent that fuses particulate build material into a solid object.

The print liquid supply (324) also includes an interface (328). The interface (328) includes components to electrically and fluidly couple the print liquid supply (324) to the printer (210). For example, the interface (328) may include an electrical connection that matches with the electrical interface (108) such that data may be transmitted. Types of data that may be transferred include control information from the printer (210) to the print liquid supply (324). Data may also be transferred from the print liquid supply (324) to the printer (210), such as characteristics of the liquid contained therein. In some examples, the interface (328) protrudes from the reservoir (326). The interface (328) may be a low-profile interface that protrudes from the reservoir over a distance that is ten times less than a total height from the reservoir. That is, the interface (328) may have a height that is at least ten times smaller than a height of the reservoir (326). The interface (328) may also be narrower than the reservoir (326). That is, the interface (328) may have a width that is at least three time smaller than a total width of the reservoir (326).

The interface (328) may also include a port, or other mechanism by which liquid is expelled from the reservoir (326). For example, the port may include a septum which is pierced by the needle (102), or a valve which is opened by the needle (102) such that liquid can be expelled. The reservoir (326) refers to a component of the print liquid supply that holds fluid. In some examples, the reservoir may have a capacity of at least 1 liter. For example, the maximum capacity may be at least 3 liters, at least 5 liters, or at least 10 liters.

The interface (328) also includes protrusions (330), specifically a first protrusion (330-1) and a second protrusion (330-2) that interface with the actuators (220-1, 220-2) to move the retractable plate (218). That is, upon insertion, the protrusions (330), if they match the keyed slots (104-1, 104-2), press against the actuators (220-1, 220-2) to retract the retractable plate (218) to a state wherein upon further insertion the needle (102) and electrical interface (108) interact with corresponding components on the print liquid supply to facilitate liquid delivery.

For example, the electrical interface (108) may extend between one of the protrusions (330-1) and a liquid output which liquid output receives a fluid needle. This electrical interface (108) may be parallel, or approximately parallel to a wall of the reservoir (326) from which the interface (328) extends. Contact pads of the electrical interface (328) extend along a lie perpendicular to a needle insertion direction of the liquid output.

For example, the shape and size may relate to a particular color of ink that is intended to be inserted into that particular port (216). Accordingly, interfaces (324) on print liquid supplies with different color ink would have different shaped and sized protrusions (330) and therefore would not be able to be inserted into the port (216) on account of not matching up with the associated keyed slots (104). In another example, the protrusions (330) may be modified via rotation. That is, the protrusions (330) for each interface (324) may the same size and shape, but may have different radial orientation about its axis. By doing so, the one protrusion (330) could be used for multiple configurations.

While FIG. 3 depicts a single interconnect (100) and interface (328) per port (216)/print liquid supply, in some examples there may be multiple interconnects (100) and interfaces (328) per port (216)/print liquid supply pair. Doing so may allow ink recirculation and stirring inside the print liquid supply.

FIG. 4 is an isometric view of an interconnect (100) with keyed slots (FIG. 1, 104) and multiple print liquid supplies (324-1, 324-2, 324-3, 324-4), according to an example of the principles described herein. As described above, the print liquid supplies (324) provide print liquid to a printer (FIG. 2, 210) or other ejection device. Accordingly, in some examples, a printer (FIG. 2, 210) includes ports (216) to receive the print liquid supplies (324). The ports (216) may have a uniformly-sized opening. Accordingly, the dimension of each print liquid supply (324), regardless of the volume, may have a size to fit in the opening. That is, each supply (324) depicted in FIG. 4 has a different volume on account of them having different lengths. However, the dimensions of each supply (324) that correspond to the opening in the port (216) is the same. In some example, the front surface, i.e., the surface exposed to a user, may have an aspect ratio of at least 1.1. As a specific example, each supply (324) face may have an aspect ratio of between 1.5 and 2.0. That is, the height of the supply (324) may be 1.5 to 2 times greater than the width of the supply (324). In another example, the aspect ratio may be less than 1. By having the supply (324) with the same front surface shape and size, regardless of a length, and therefore volume, a variety of volumes of print supplies (324) can be used in a given supply port (216). That is, rather than being limited to containing just one size of a print supply, a port (216) can accept a variety of supplies (324) having different volumes, each with the same front surface size and shape and the same color of liquid.

FIG. 4 also depicts the location of the print liquid supply interconnect (100). Specifically, as depicted in FIG. 4, the interconnect (100) may be disposed at an opening of the port (216). Still further, the interconnect (100) may be disposed at a bottom of the port (216). Doing so facilitates fluid flow out of the print liquid supply (324) as gravity will naturally draw the liquid down and out. While specific reference is made to the interconnect (100) disposed at a bottom of the port (216), the interconnect (100) may be disposed at any part of the opening.

Putting the interconnect (100) at the front of the port (216) near the opening allows for liquid supplies (324) with different lengths to be easily inserted into the port (216) by a user. For example, were the interconnect (100) near the back of a port (216), a user would have to extend their hand fully inside the port (216) to insert a smaller liquid supply (324).

Figure 5:
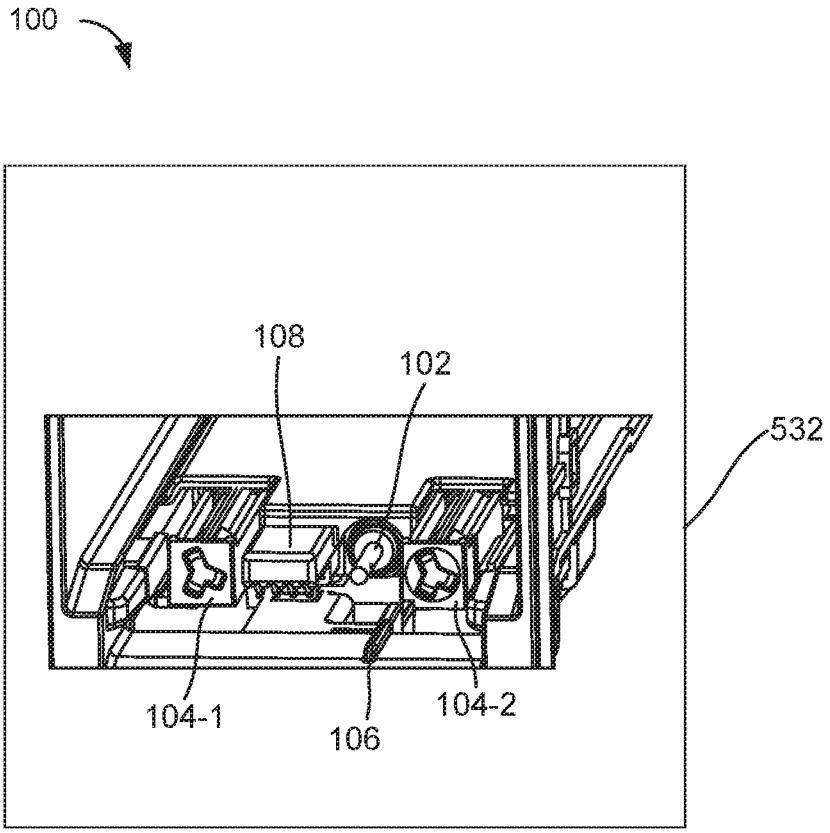
FIG. 5 is a diagram of a hose-fed print liquid supply interconnect with keyed slots, according to an example of the principles described herein.
Figure 6:
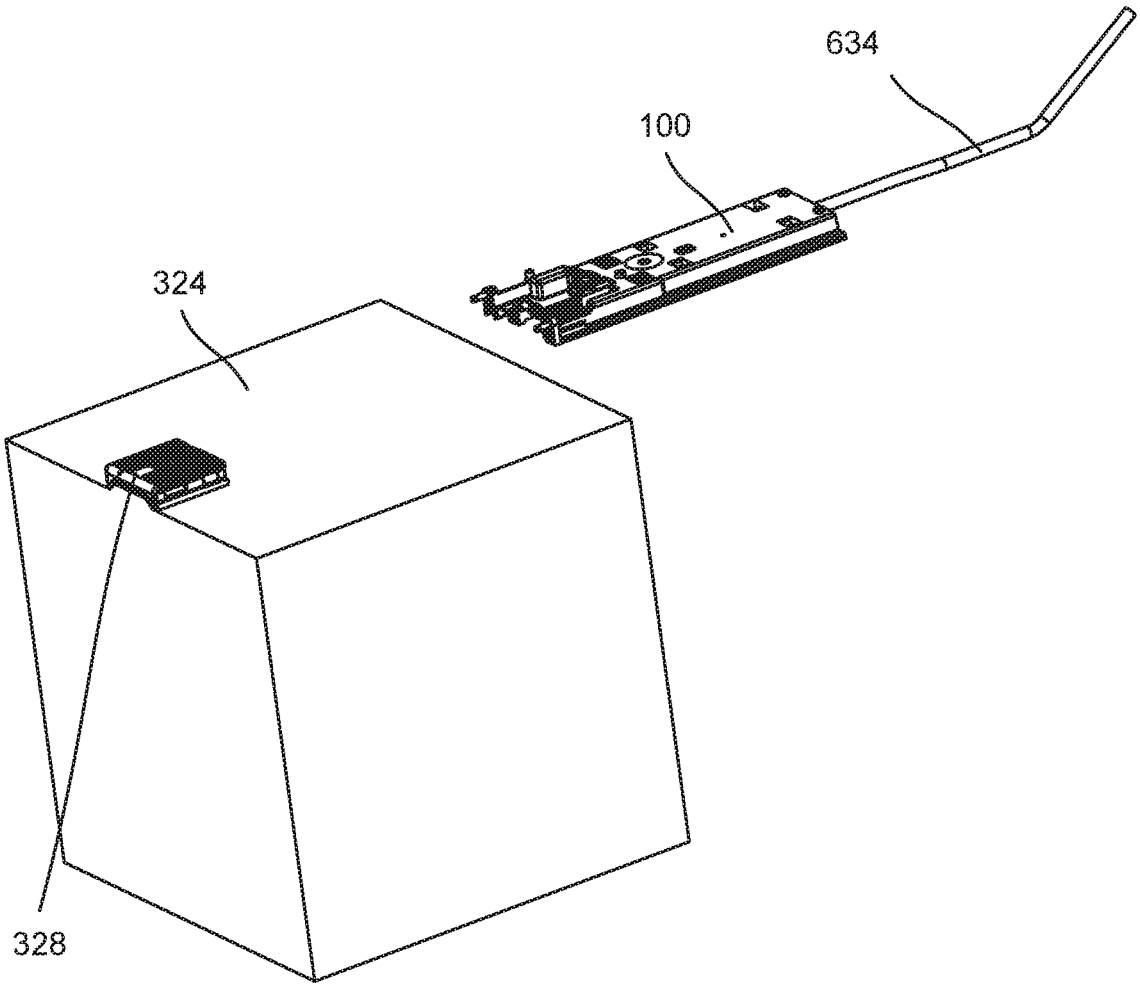
FIG. 6 is an isometric view of a hose-fed print liquid supply interconnect with keyed slots and a print liquid supply, according to an example of the principles described herein.

FIG. 5 is a diagram of a hose-fed print liquid supply interconnect (100) with keyed slots (104), according to an example of the principles described herein. In this example, the print liquid supply interconnect (100) includes the needle (102), first keyed slot (104-1), second keyed slot (104-2), guide feature (106), and electrical interface (108) similar to those components described in connection with FIG. 1.

In this example, the interconnect (100) also includes a housing (532) in which these components are disposed. This housing (532) and the components disposed therein may be movable relative to the printer that it is associated with, but may be coupled to the printer via a feed hose. That is, the feed hose may act as a tether between the print liquid supply interconnect (100) and the printer (FIG. 2, 210). The feed hose directs fluid from the print liquid supply (FIG. 3, 324) to the printer (FIG. 2, 210). In other words, the print liquid supply interconnect (100) may be movable relative to the printer (FIG. 2, 210) and may extend away from the printer (FIG. 2, 210) while being tethered to the printer (FIG. 2, 210). Such a system enhances the use of larger print liquid supplies (FIG. 3, 324). For example, the print liquid supply (FIG. 3, 324) may be too large to insert into a printer (FIG. 2, 210). In this example, the large print liquid supply (FIG. 3, 324) may remain stationary on the floor or other surface, not inside the printer (FIG. 2, 210). A user may then grasp the print liquid supply interconnect (100), move it to where the print liquid supply (FIG. 3, 324) is located, and couple the interconnect (100) to the print liquid supply (FIG. 3, 324). In this example, the interconnect (100) is tethered to the printer (FIG. 2, 210) via the feed hose such that liquid may still pass from the print liquid supply (FIG. 3, 324) via the feed hose tether.

Figure 7:
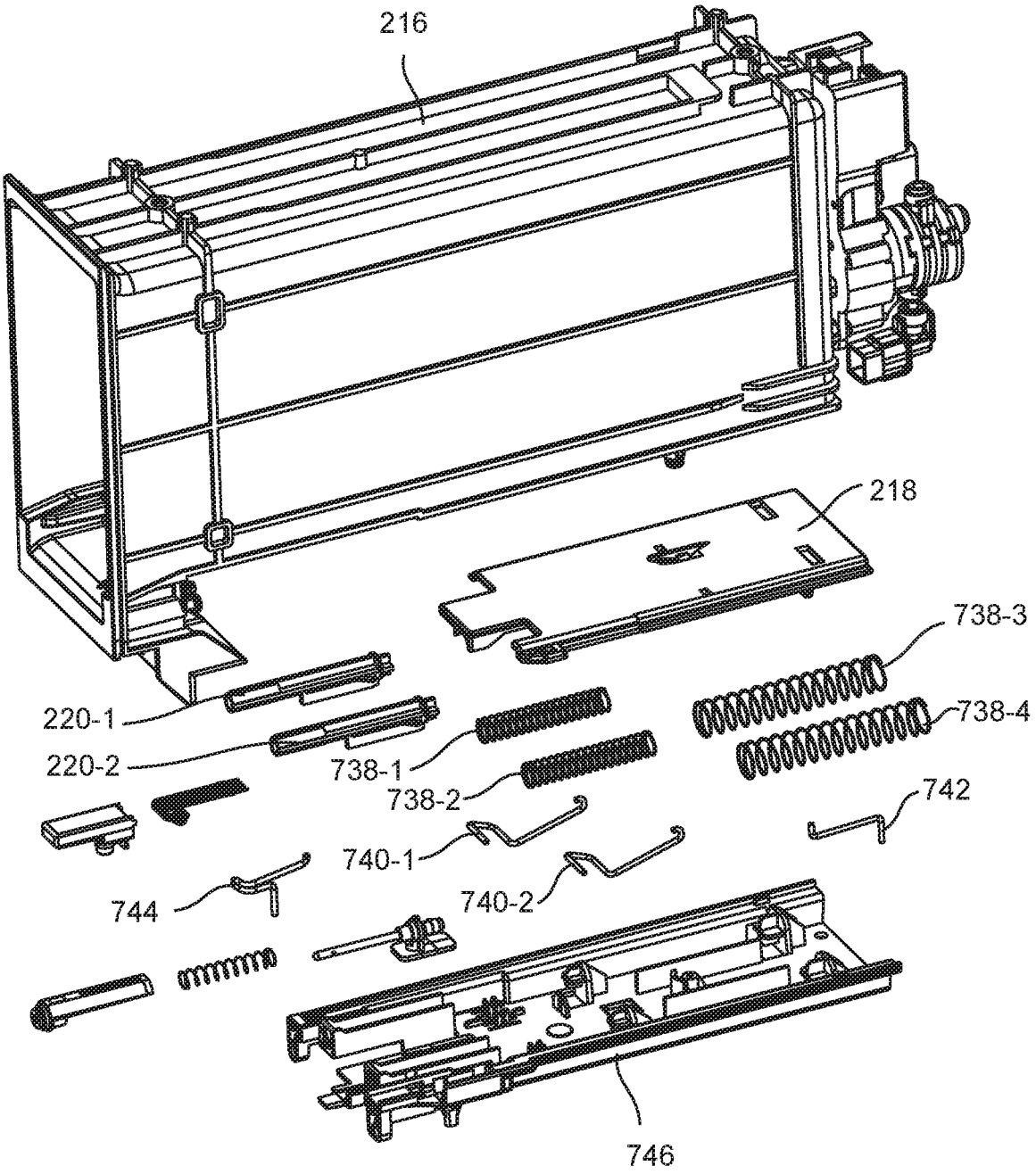
FIG. 7 is an exploded view of a latch assembly for moving the retractable plate and for securing the print liquid supply in place, according to an example of the principles described herein.

FIG. 7 is an isometric view of a hose-fed print liquid supply interconnect (100) with keyed slots (FIG. 1, 104) and a print liquid supply (324), according to an example of the principles described herein. As described above, some print liquid supplies (324) are large and may be unruly to position inside a printer (FIG. 2, 210). Such print liquid supplies (324) may be more conveniently placed on a surface such as a ground and not inserted into a printer (FIG., 210). In this example, the print liquid supply interconnect (100) may be removable from, yet tethered to, the printer (210). Specifically, the housing (532) is coupled to the end of a feed hose (634) which feed hose (634) supplies fluid from an attached print liquid supply (FIG. 3, 324) to an attached printer (210). The feed hose (634) may be flexible such that it can be easily located to a particular print liquid supply (FIG. 3, 324).

In this example, the interconnect (100) is brought to the print liquid supply (324) and attached to the interface (328) of the print liquid supply. That is, the interconnect (100) extends away from the printer (FIG. 2, 210). The interconnect (100) provides an electrical and fluidic connection between the print liquid supply (324) and the printer (FIG. 2, 210). The fluid and information may pass through, or along, the feed hose (634). While FIG. 7 depicts one print liquid supply interconnect (100), the printer (210) may be coupled to multiple interconnects (100) coupled via multiple feed hoses (634) to the same printer (210). In this example, each interconnect (100) is associated with a different color and has keyed slots (104) with different sizes and/or shapes.

Figure 8:
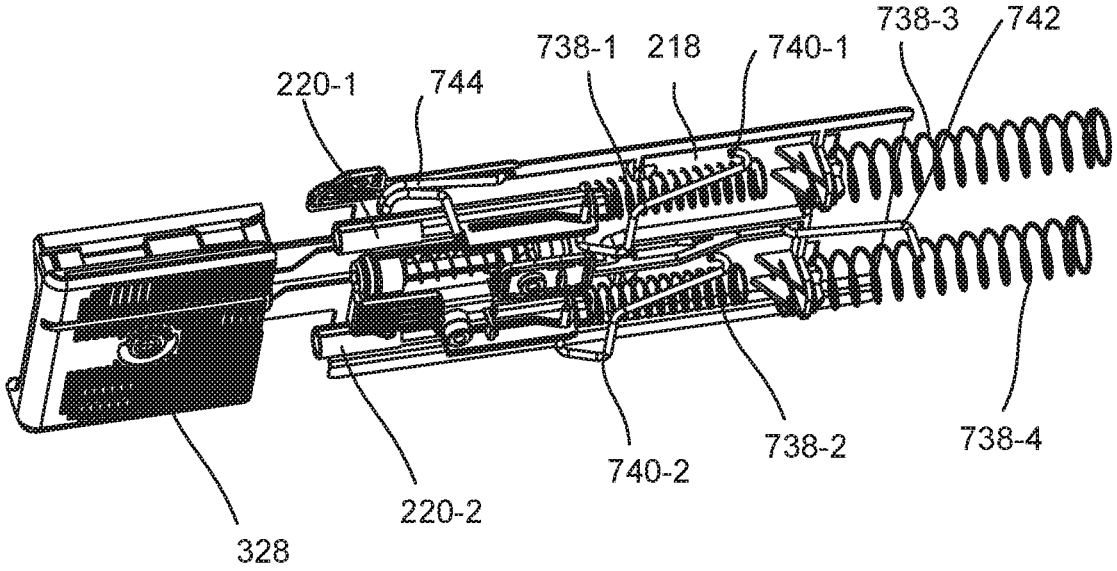
FIG. 8 is an isometric view of a latch assembly for moving the retractable plate and for securing the print liquid supply in place, according to an example of the principles described herein.

FIGS. 7 and 8 are views of a latch assembly for moving the retractable plate (218) and for securing the print liquid supply (FIG. 3, 324) in place, according to examples of the principles described herein. Specifically, FIG. 7 is an exploded view of a latch assembly and FIG. 8 is an isometric view of the underside of the port (FIG. 2, 216) with the latch assembly in place. The latch assembly is actuated by insertion of the protrusions (FIG. 3, 330) into the keyed slots (FIG. 1, 104). Specifically, as the actuators (220-1, 220-2) are pushed backwards by the protrusions (FIG. 3, 330), they activate the latch assembly. Note that initially, both the actuators (220) and retractable plate (218) are biased in a forward, or extended position, by various springs (738-1, 738-2, 738-3, 738-4). Upon insertion of the print liquid supply (FIG. 3, 324), these springs (738) are compressed to retract the retractable plate (218).

As the actuators (220-1, 220-2) slide backwards, wireforms (740) in the latch assembly disengage from the plate (218). That is, in the extended position, these wireforms (740) are engaged with the plate (218) to prevent unwanted retraction. Disengagement of the wireforms (740) via the movement of the actuators (220) allows the plate (218) to fully retract. The retractable plate (218) sits on a base (746) and slides thereon.

The latch assembly also includes various latches to guide and retain certain components. For example, a plate latch (742) guides the motion of the retractable plate (742). Specifically, as the retractable plate (218) is pushed backwards, the end of the plate latch (742) in a track retains the retractable plate (218) in a retracted state. With an additional push by the user in the same direction, the plate latch (742) continues to move in the track so as to allow the retractable plate (218) to return to the extended position. FIGS. 10A-10E provide an example of the movement of the plate latch (742) relative to a first latch track in the retractable plate (218).

The latch assembly also includes a plate latch (744). The plate latch (744) similarly moves in a latch track. During insertion, a protrusion on the plate latch (744) is moved out of the way such that the print liquid supply (FIG. 3, 324) can be inserted. The latch track is such that as the print liquid supply (FIG. 3, 324) is fully seated, the hook on the plate latch (744) interfaces with a slot on the print liquid supply (FIG. 3, 324) to mechanically retain the print liquid supply (FIG. 3, 324) in a predetermined position in the port (FIG. 2, 216). FIGS. 11A-11E provide an example of the movement of the supply latch (744) relative to a second latch track in the retractable plate (218).

FIGS. 9A-9D illustrate the operation of the protrusions (330), keyed slots (104), actuators (220) and wireform (740) during insertion and removal of a print liquid supply (FIG. 3, 324), according to an example of the principles described herein. These components operate to move the retractable plate (218) such that the needle (FIG. 1, 102) and electrical interface (FIG. 1, 108) may interface with corresponding components on the print liquid supply (324).

Figure 9A:
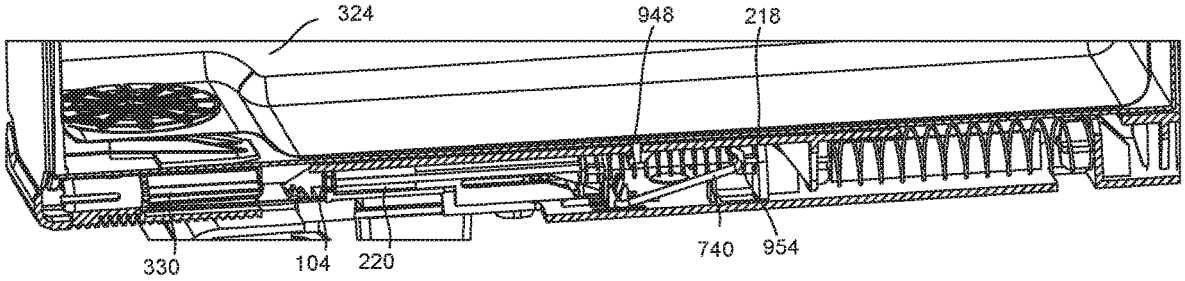
FIGS. 9A-9D illustrate the operation of the protrusions, keyed slots, actuators, and wireform during insertion and removal of a print liquid supply, according to an example of the principles described herein.

FIG. 9A depicts these components in a pre-insertion state. In the pre-insertion state, the protrusions (330) have not yet passed through the keyed slots (104) to move the actuators (220). Also in this pre-insertion position, a second end (954) of the wireform (740) is in a raised position. In this position, were the retractable plate (218) to be pushed back, a catch (948) on the retractable plate (218) would interface with the second end (954) to prevent movement of the retractable plate (218) beyond a desired point.

Figure 9B:
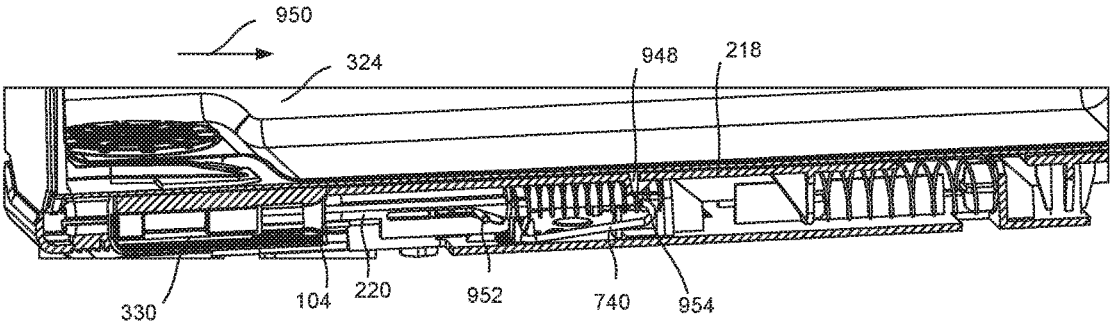

FIG. 9B depicts the components during insertion of the print liquid supply (324). In this example, a user presses the print liquid supply (324) in a direction indicated by the arrow (950). Responsive to such a force, the protrusions (330) pass through the keyed slots (104) and subsequently push on the perimeter of the actuators (220). In addition to the protrusions (330) of the interface (FIG. 3, 328) pushing on the actuators (220), the interface (FIG. 3, 328) body itself pushes on the retractable plate (218). In other words, both the actuators (220) and the retractable plate (218) move in a direction indicated by the arrow (950). As the actuators (220) move, a first end (952) of the wireform (740) slides in a slot on the actuator (220) in an upward direction. As the wireform (740) is pivotally coupled to a base, this motion causes the second end (954) of the wireform (740) to travel downward and out of the way of the catch (948).

With the second end (954) in the downward position, the catch (948) passes by the second end (954) and the retractable plate (218) can move into a more retracted position along the direction indicated by the arrow (950).

Figure 9C:
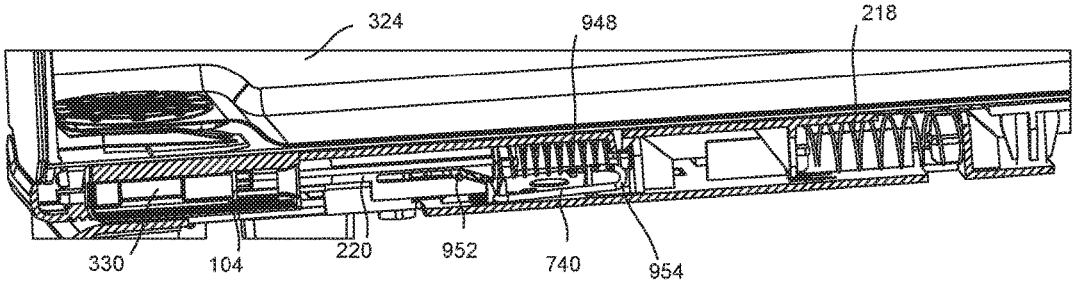

FIG. 9C depicts the print liquid supply (324) fully seated in an operating state. As seen in this example, the catch (948)

of the retractable plate (218) has passed by the lowered second end (954). The retractable plate (218) remains in this retracted position via operation of the plate latch (742) detailed in FIGS. 10A-10E and the print liquid supply (324) remains coupled thereto via operation of the supply latch (744) detailed in FIGS. 11A-11E.

Figure 9D:
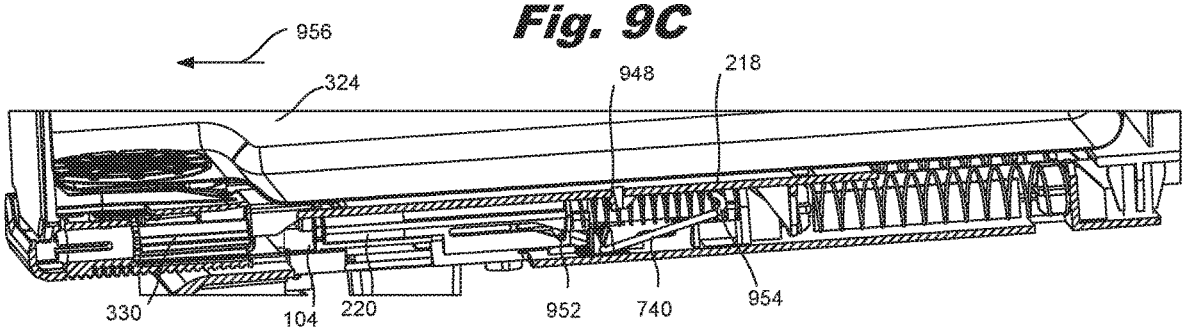

FIG. 9D depicts the print liquid supply in an ejection state wherein the retractable plate (218) returns to the extended position. Responsive to a user action such as pushing on the print liquid supply (324) in the direction indicated by the arrow (950) in FIG. 9B, the print liquid supply (324) is ejected.

During this operation, the protrusions (330) are removed such that the springs (FIG. 9, 738) press the actuators (220) back to the extended position indicated by the arrow (956). In so doing, the first end (952) of the wireform (740) slides in a generally downward direction within the actuator (220) slot, deflecting the second end (954) upwards at the pivot point and the catch (948) is moved to the front side of the second end (954). In such a fashion, the second end (954) again prevents over retraction as the plate catch (948).

Figure 10A:
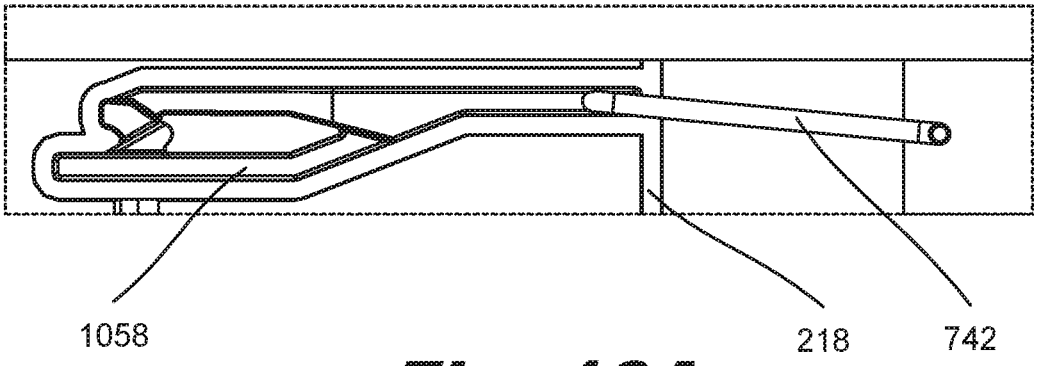
FIGS. 10A-10E illustrate the operation of the plate latch during insertion and removal of a print liquid supply, according to an example of the principles described herein.

FIGS. 10A-10E illustrate the operation of the plate latch (742) during insertion and removal of a print liquid supply (FIG. 3, 324), according to an example of the principles described herein. The plate latch (742) operates to guide the motion of the retractable plate (218) between the extended and retracted position and maintains the retractable plate (218) in the retracted position. Specifically, FIG. 10A depicts the plate latch (742) in a pre-insertion state. In the pre-insertion state, the retractable plate (218) is extended past the needle (FIG. 1, 102) and electrical interface (FIG. 1, 108) to protect them from mechanical damage. As described above, the retractable plate (218) includes a first latch track (1058) that guides and retains the retractable plate (218) in certain states. In the pre-insertion state, the springs (FIG. 9, 738) bias against the retractable plate (218) to maintain it in the extended state indicated in FIG. 10A.

Figure 10B:
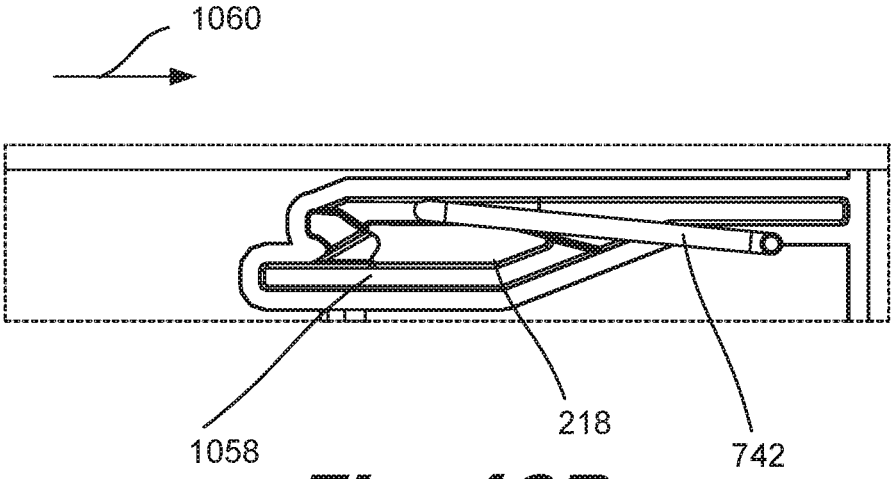
Figure 10C:
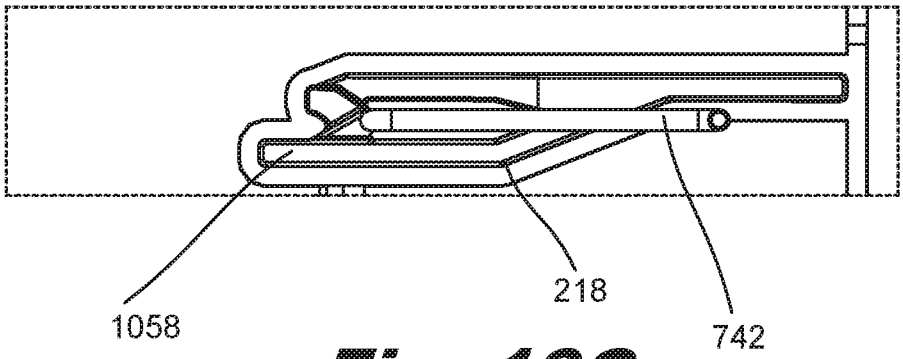

In FIG. 10B a user presses the print liquid supply (FIG. 3, 324) into the port (FIG. 2, 216) in a direction indicated by the arrow (1060). In so doing, the interface (FIG. 3, 328) exerts a force against the retractable plate (218) also in the direction indicated by the arrow (1060), which moves the retractable plate (218). The retractable plate (218) then moves as guided by the latch hook (742) in the first latch track (1058) until it is fully seated in an operating position as indicated in FIG. 100.

Upon removal of the force as indicated in FIG. 100, the retractable plate (218) is maintained in place due to the spring force (FIG. 9, 738) and the latch hook (742) position within the first latch track (1058). The latch hook (742) remaining in the fully seated position retains the retractable plate (218) in a retracted position. In the retracted position, the needle (FIG. 1, 102) and electrical interface (FIG. 1, 108) are accessible to the print liquid supply (FIG. 3, 324).

Figure 10D:
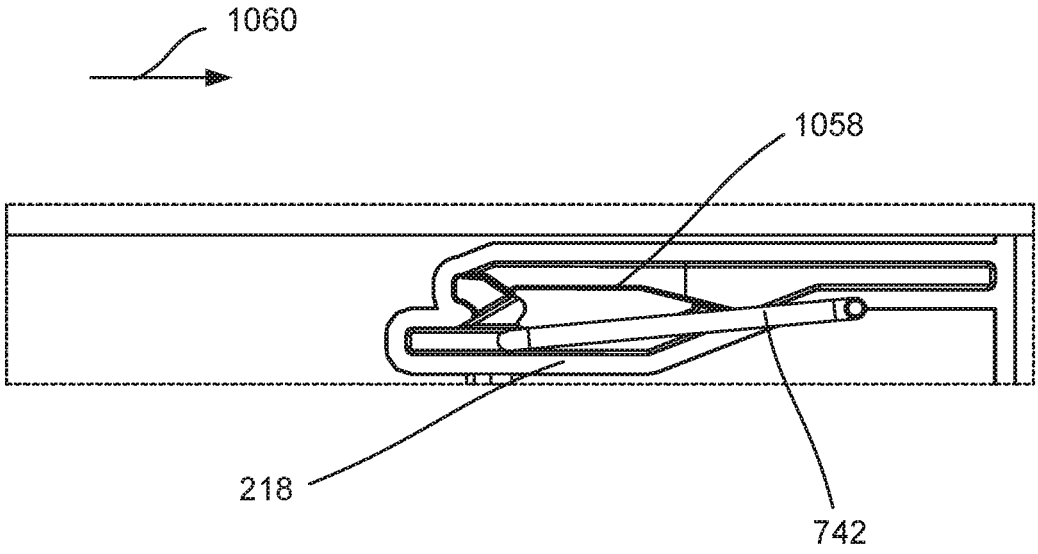
Figure 10E:
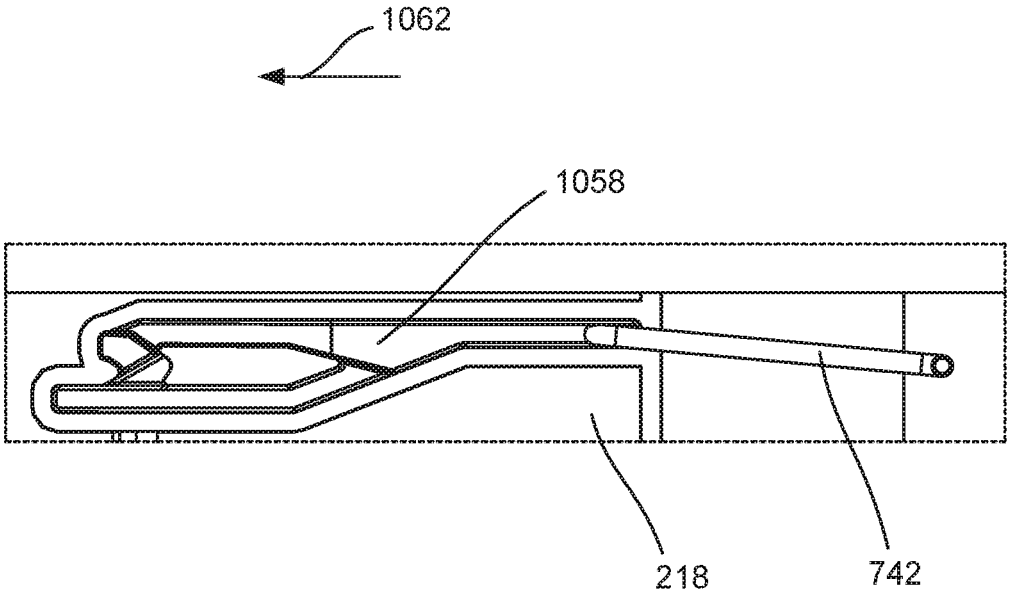

To eject the print liquid supply (FIG. 3, 324) and return the retractable plate (218) to the extended position, a user pushes the print liquid supply (FIG. 3, 324) in the direction indicated by the arrow (1060) in FIG. 10D to unseat the plate latch (742) from its stable position. Once unseated, the latch hook (742) and the first latch track (1056) allow the retractable plate (218) to move in a direction indicated by the arrow (1062) in FIG. 10E to return to the extended position, where again the retractable plate (218) protects the needle (FIG. 1, 102) and electrical interface (FIG. 1, 108) from mechanical damage.

Figure 11A:
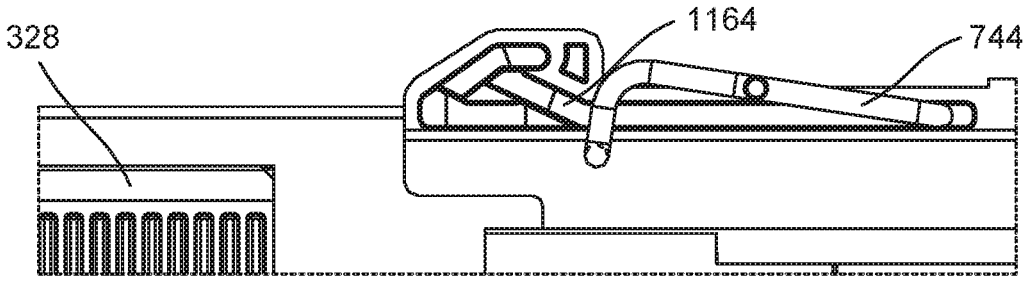
FIGS. 11A-11E illustrate the operation of the supply latch during insertion and removal of a print liquid supply, according to an example of the principles described herein.

FIGS. 11A-11E illustrate the operation of the supply latch (744) during insertion and removal of a print liquid supply (FIG. 3, 324), according to an example of the principles described herein. The supply latch (744) operates to retain the print liquid supply (FIG. 3, 324) in place during operation. Specifically, FIG. 11A depicts the supply latch (742) in a pre-insertion state. In the pre-insertion state, the retractable plate (218) is extended past the needle (FIG. 1, 102) and electrical interface (FIG. 1, 108) to protect them from mechanical damage. As described above, the retractable plate (218) includes a second latch track (1164) that guides the supply latch (744) to retain the print supply liquid (FIG. 3, 324) to the interconnect (FIG. 1, 100) during user.

Figure 11B:
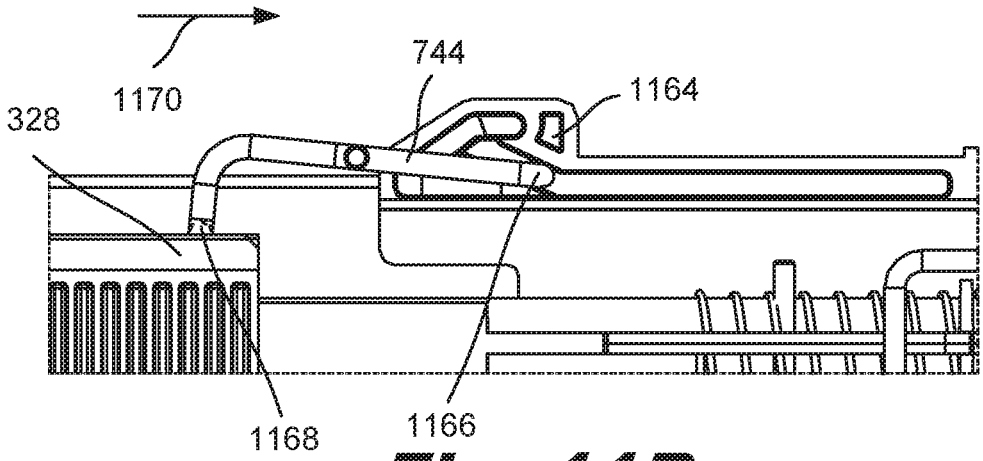
Figure 11C:
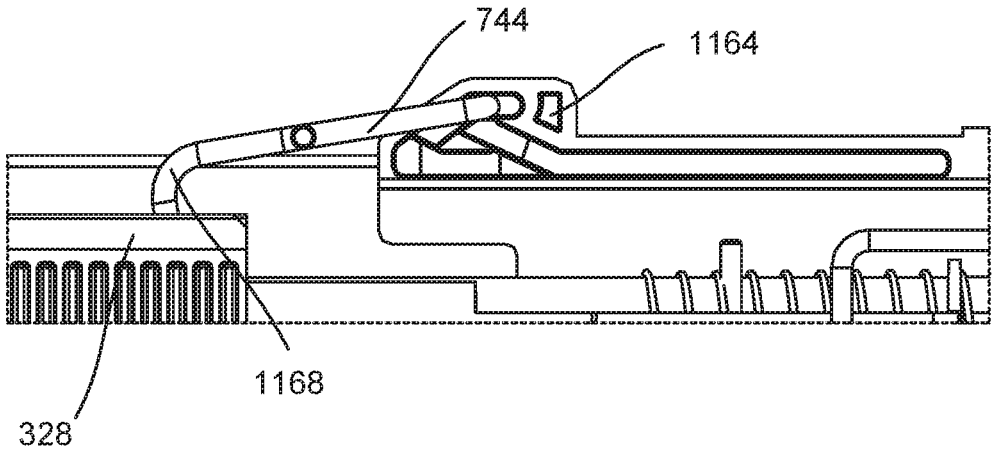

In FIG. 11B, a user presses the print liquid supply (FIG. 3, 324) into the port (FIG. 2, 216) in a direction indicated by the arrow (1170). In so doing, a first end (1166) of the supply latch (744) is directed generally upwards. As the supply latch (744) is pivotally coupled to the base (FIG. 9, 746), the second end (1168) of the supply latch (744) travels in a generally downward direction to insert into a slot in the interface (328). Upon removal of the force as indicated in FIG. 11C, the print liquid supply (FIG. 3, 324) is coupled to the interconnect (FIG. 1, 100) via the second end (1168) being inserted into a slot in the interface (FIG. 3, 328).

Figure 11D:
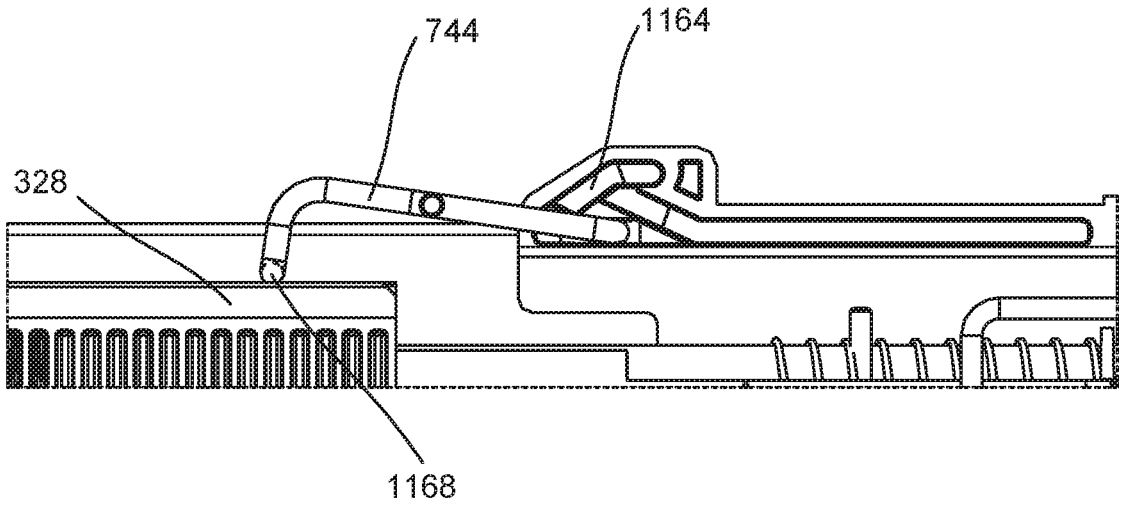
Figure 11E:
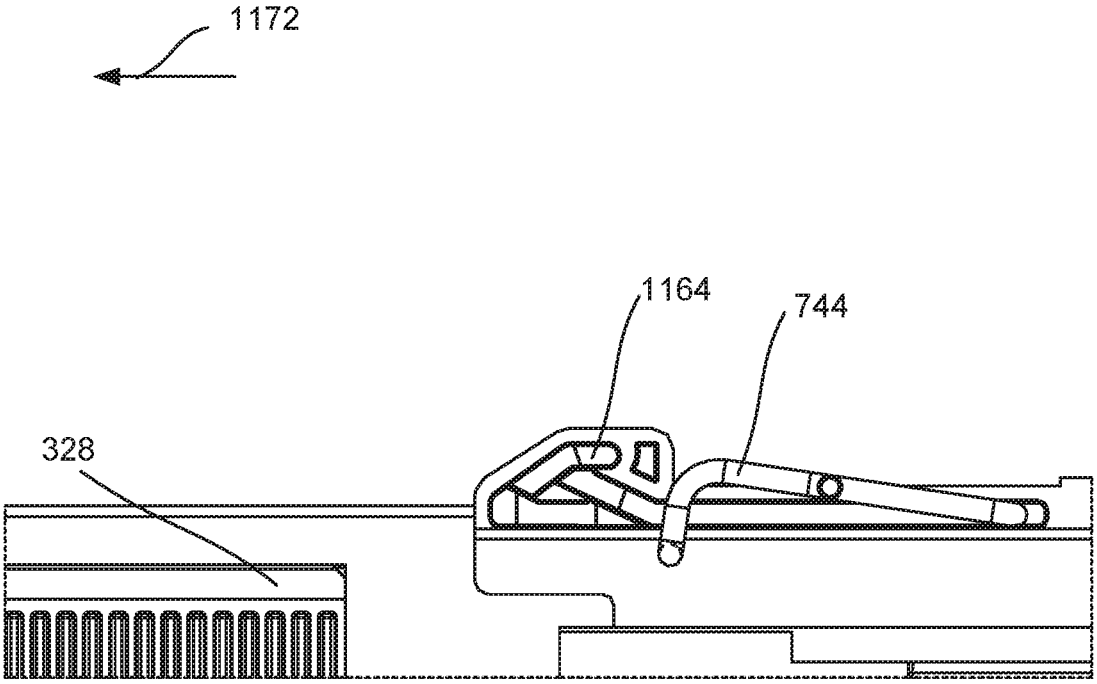

After a slight force in the direction indicated by the arrow (1060) in FIG. 11D, the first end (1166) of the supply latch (744) is unseated from its stable position as indicated in FIG. 11D. Once unseated, the plate latch (744) and the second latch track (1164) remove the second end (1168) from the slot in the interface (328) as indicated in FIG. 11E and allows the print liquid supply (FIG. 3, 324) to move in a direction indicated by the arrow (1172) in FIG. 11E to be removed from the port (FIG. 2, 216).

Figure 12:
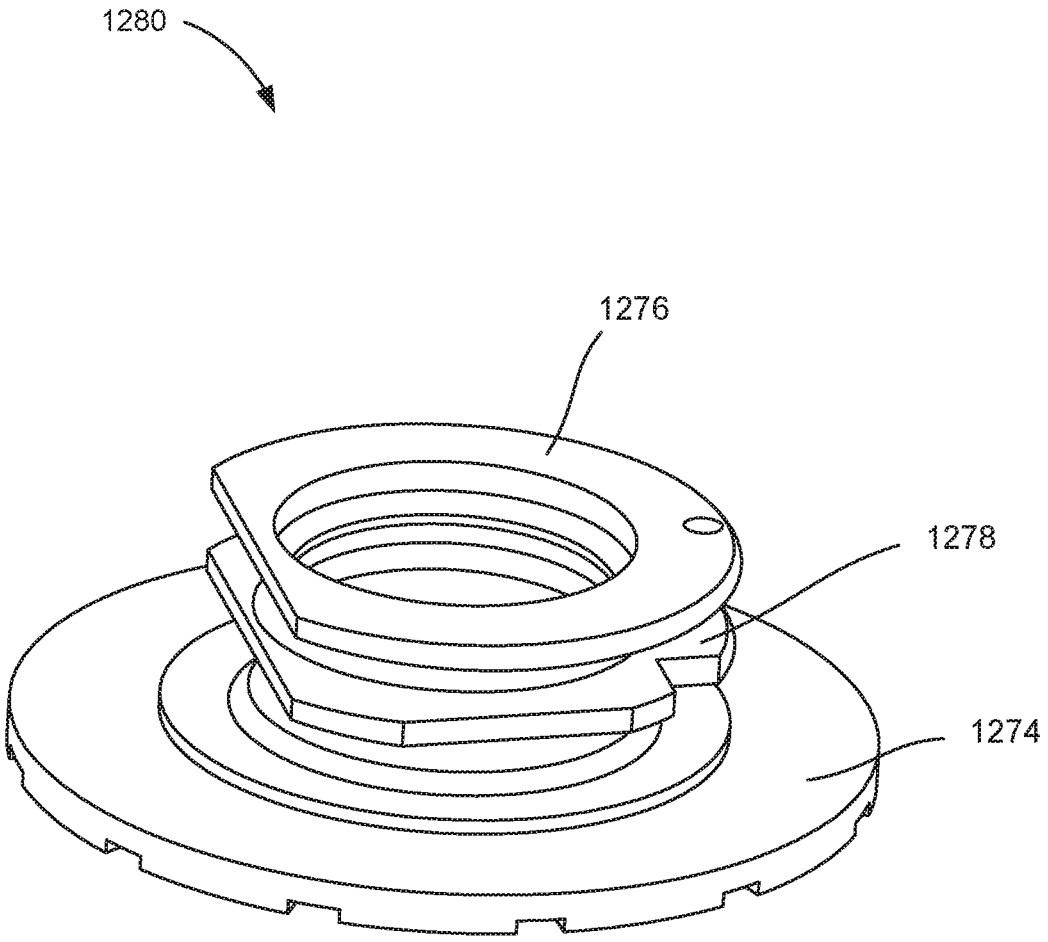
FIG. 12 is an isometric view of a spout of the print liquid supply, according to an example of the principles described herein.

FIG. 12 is an isometric view of a spout (1280) of the print liquid supply (FIG. 3, 324), according to an example of the principles described herein. The spout (1280) enables print liquid disposed within a reservoir to be passed to an ejection device for deposition on a surface. The spout (1280) may be formed of any material such as a polymeric material. In a specific example, the spout (1280) is formed of polyethylene.

The spout (1280) includes various features to ensure accurate and effective liquid transportation. Specifically, the spout (1280) includes a first flange (1274) extending from a sleeve. The first flange (1274) affixes the spout (1280) to the reservoir. Heat and/or pressure may then be applied to the spout (1280) and reservoir such that the first flange (1274) material composition and/or the reservoir material composition alters and the spout (1280) and reservoir are permanently affixed to one another. In this fashion, the first flange (1274) affixes the spout (1280) to the reservoir.

The spout (1280) also includes a second flange (1276) extending from the sleeve that affixes the spout (1280) and corresponding reservoir to the container in which they are disposed. That is, during use, it is desirable that the spout (1280) remains in one position and not move from that position. Were the spout (1280) to move, this might affect the fluid delivery. For example, if the spout (1280) were to translate, it may not line up with the interface on an ejection device such that fluid would not be delivered as desired to the ejection device, or may not be delivered at all. Moreover, such a misalignment could result in liquid leak and/or damage to components of the ejection device or the liquid supply. Accordingly, the second flange (1276), along with the angled clamp flange (1278) operate to locate the spout (1280) in a predetermined position without movement relative to a container.

More specifically, when installed, the second flange (1276) sits on a wall of the container in which the reservoir is disposed. A clamp plate and a surface of the print liquid supply container are disposed and squeezed, between the second flange (1276) and the angled clamp flange (1278). The force between the second flange (1276) and the container secures the spout (1280) in place relative to the container. As the container is rigid, the spout (1280) therefore is rigidly located as well.

The spout (1280) also includes an angled clamp flange (1278). As described above, the angled clamp flange (1278), along with the second flange (1276) securely affix the spout (1280), and the reservoir to which it is attached, to the container such that it does not move relative to the container. Any relative movement between the container and the spout (1280) may compromise the liquid path between the reservoir and the ejection device thus result in ineffective liquid delivery, liquid leaks, and/or component damage.

Figure 13:
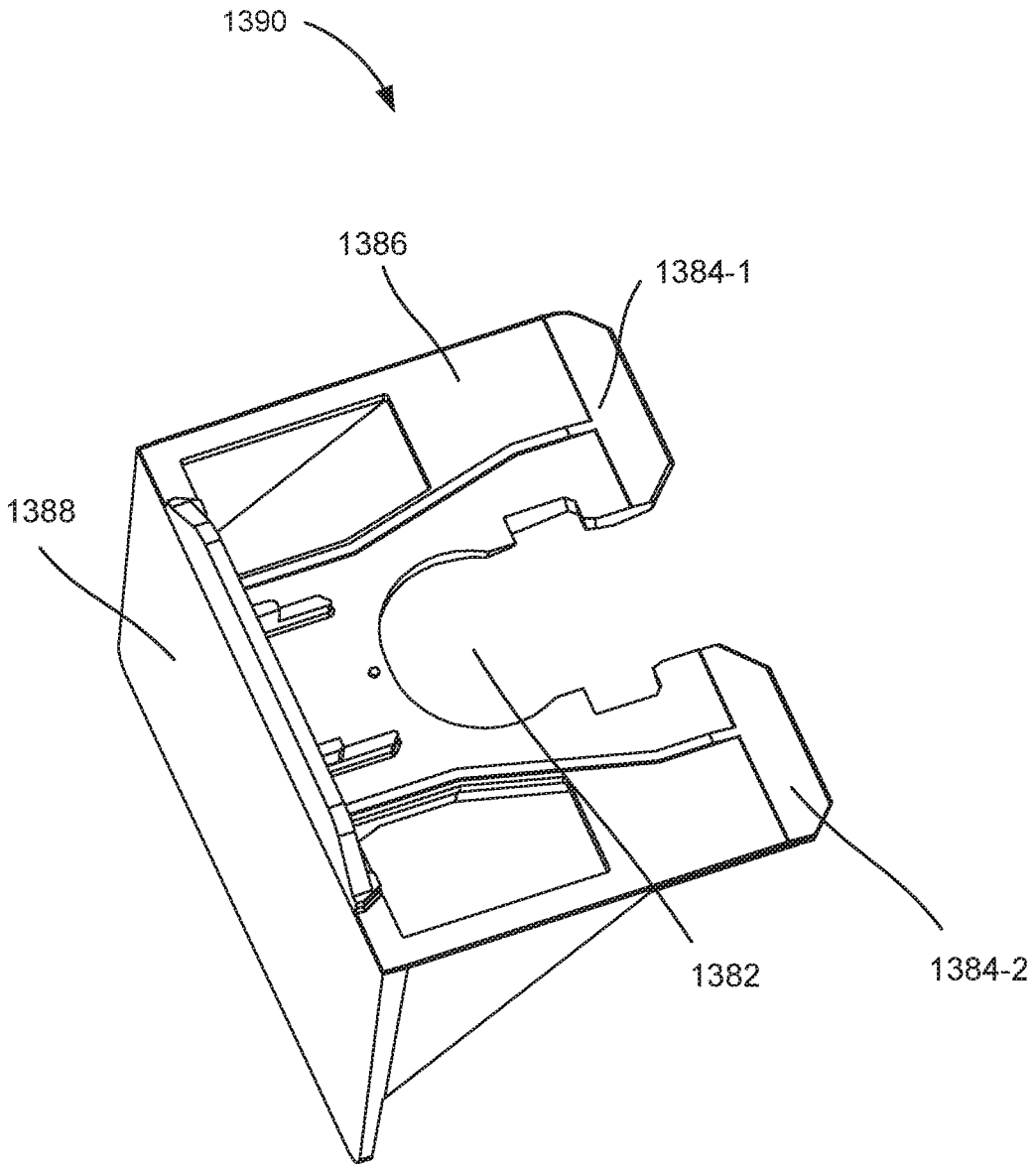
FIG. 13 is an isometric view of a clamp plate assembly of the print liquid supply, according to an example of the principles described herein.

FIG. 13 is an isometric view of a clamp plate assembly (1390) of the print liquid supply (FIG. 3, 324), according to an example of the principles described herein. The clamp plate assembly (1390) includes a clamp plate (1386) that interfaces with the spout (FIG. 12, 1280) to secure the spout (FIG. 12, 1280) and reservoir firmly in a predetermined position such that the spout (FIG. 12, 1280) can interface with a connection of the ejection device to deliver liquid to the ejection device. The clamp plate assembly (1390) also includes a back plate (1388) that is approximately orthogonal to the clamp plate (1386). Pushing the back plate (1388) engages the wedge-shaped forked ends (1384-1, 1384-2) of the clamp plate (1386) to engage the spout (FIG. 12, 1280).

The clamp plate (1386) includes various components to facilitate such an interface with the spout (FIG. 12, 1280). Specifically, the clamp plate (1386) includes a slot (1382) defined by two wedge-shaped forked ends (1384-1, 1384-2). The slot (1382) receives and retains the spout (FIG. 12, 1280).

The forked ends (1384-1, 1384-2) may be wedge-shaped. Accordingly, during insertion, the angle of the wedge interfaces with the angle of the angled clamp plate (FIG. 12, 1278) to affix the container against the second flange (FIG. 1, 108). The pressure between the container and the second flange (FIG. 12, 1276) prevents the relative motion of these components such that a rigid interface is provided. The rigid interface ensures that the spout (FIG. 12, 1280) does not move as the container is inserted into a printer nor during operation.

Figure 14:
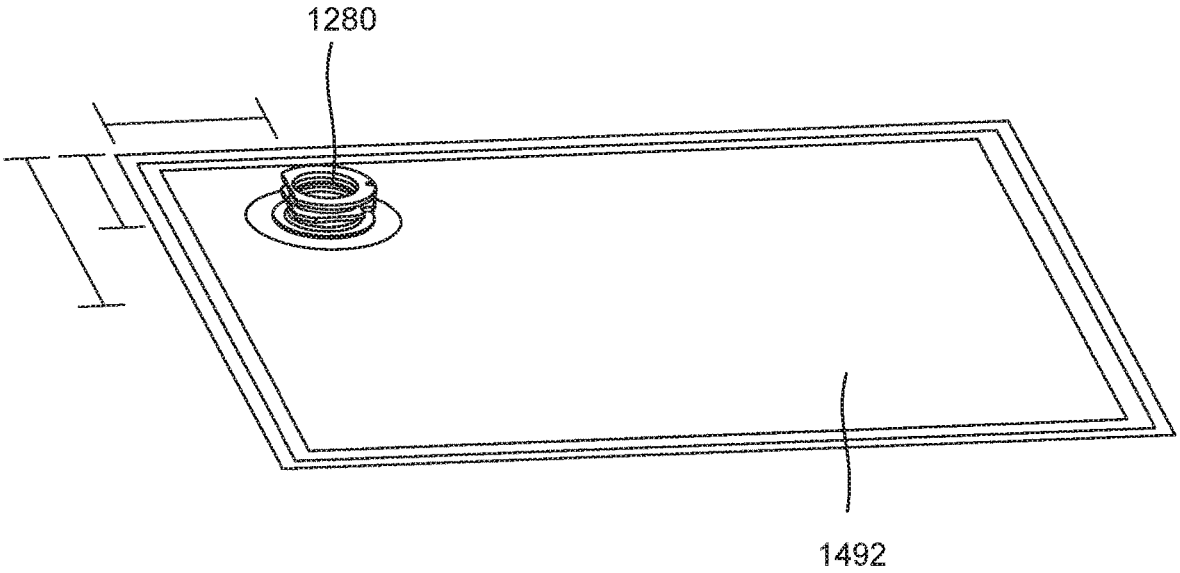
FIG. 14 is an isometric view of the print liquid supply reservoir, according to an example of the principles described herein.

FIG. 14 is an isometric view of the print liquid supply reservoir (1492), according to an example of the principles described herein. In some examples, the reservoir (1492) may be a collapsible reservoir (1492). That is, the reservoir (1492) may form to the contents disposed therein.

The reservoir (1492) may be any size and may be defined by the amount of liquid which it can hold. For example, the reservoir (1492) may hold at least 100 millimeters of liquid. While specific reference is made to a reservoir (1492) holding a particular amount of liquid, the reservoir (1492) may hold any volume of liquid. For example, different reservoirs (1492) may hold 100, 250, 500, or 1,000 millimeters of liquid. As depicted in FIG. 14, in a generally empty state the reservoir (1492) may have a rectangular shape. While FIG. 14 depicts the corners of the reservoir (1492) as being right angles, in some cases the corners may be rounded.

FIG. 14 also clear depicts the spout (1280) affixed to the reservoir (1492) through which the print liquid passes. Specifically, the spout (1280) may be affixed at a corner of the front face at an offset from a centerline of the front face. In addition to having an offset from a centerline of the reservoir (1492), the spout (1280) may have an offset from a top edge of the reservoir (1492) and may have an offset from a side edge of the reservoir (1492). Note that the directional indicators top, bottom, and side are used for illustration in the drawings and may change during operation. For example, the top edge indicated in FIG. 14 may become the bottom edge as the reservoir (1492) is inverted during use.

Figure 15:
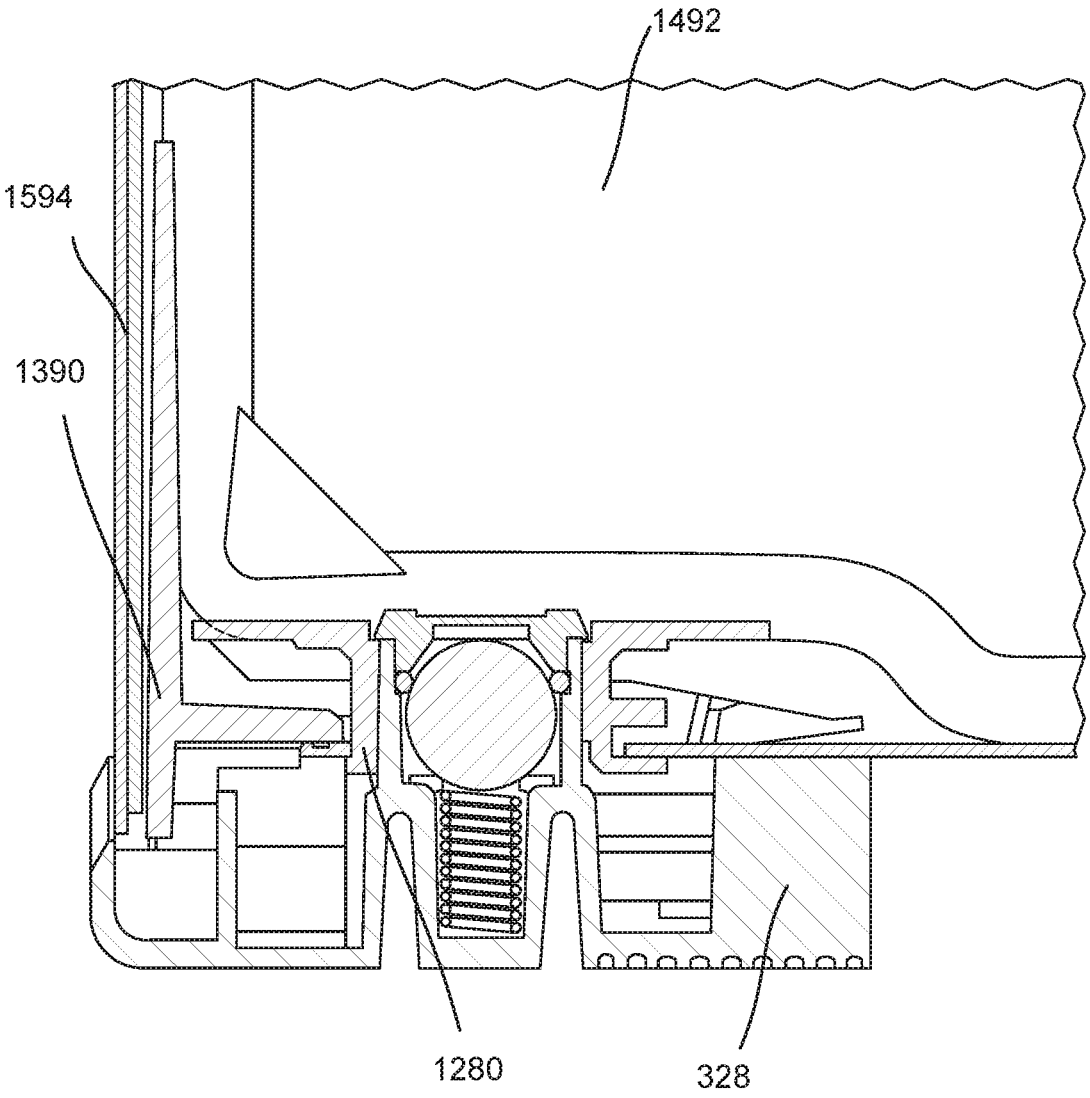
FIG. 15 is a cross-sectional view of a bag-in-box print liquid supply, according to an example of the principles described herein.

FIG. 15 is a cross-sectional view of a bag-in-box print liquid supply, according to an example of the principles described herein. As described above the print liquid supply includes a reservoir (1492) to hold a volume of print liquid, a spout (1280) through which the liquid passes, and a clamp plate (1390) to securely position the spout (1280) relative to the container of the supply. As described above, the reservoir (1492) may be disposed inside a container (1594). The container (1594) provides a rigid structure to be handled by a user during insertion. That is, while the reservoir (1492) may be easy to manufacture it is difficult to handle and due to its conforming to the shape of the contents therein, may be difficult to insert into, and couple to an ejection device. The container (1594) described herein provides structural strength such that the reservoir (1492) can be used. The container (1594) may be formed of any material including corrugated fiberboard, which may be referred to as cardboard. The corrugated fiberboard container (1594) may be easy to manufacture and may provide for effective manipulation by a user. FIG. 15 also depicts the interface (328) which is used to establish a fluidic and electrical connection between the printer (FIG. 2, 210) and the print liquid supply (FIG. 3, 324).

In summary, such an interconnect 1) accommodates connection between a printer and any number of print liquid supplies with different volumes, 2) accommodates print liquid supplies that may be too large to be inserted into a printer, 3) provides for simple coupling of a print liquid supply to a printer, and 4) provides for a satisfactory customer experience.

What is claimed is:

1. At least one print liquid supply interconnect comprising:

a housing, movable relative to a printer, and to be tethered via a feed hose to the printer, the housing comprising:

at least one needle to be inserted in a print liquid supply to allow print liquid to move between the print liquid supply and an ejection device;

two keyed slots disposed on either side of a first needle to gate insertion to a print liquid supply with protrusions that match the two keyed slots;

a guide feature adjacent the first needle extending between a first keyed slot and the first needle; and an electrical interface to establish a data transmission path between the print liquid supply and the ejection device, the electrical interface disposed between the first needle and a second keyed slot.

2. The at least one print liquid supply interconnect of claim 1, wherein the housing is coupled to an end of the feed hose.

3. The at least one print liquid supply interconnect of claim 1, wherein the feed hose is a flexible hose.

4. The at least one print liquid supply interconnect of claim 1, wherein the interconnect is separate from the printer.

5. The at least one print liquid supply interconnect of claim 1, further including an actuator behind each keyed slot.

6. The at least one print liquid supply interconnect of claim 5, further including a retractable plate to:

when a print liquid supply is not present, extend past the at least one needle and electrical interface to protect from mechanical damage; and when a print liquid supply is inserted, retract to:

expose the at least one needle to the print liquid supply; and expose the electrical interface to a corresponding interface on the print liquid supply; and wherein the two keyed slots are to:

allow matching protrusions to act upon the actuators; and prevent non-matching protrusions from acting upon the actuators.

7. The at least one print liquid supply interconnect of claim 1, further including a latch assembly actuated by insertion of the protrusions in the two keyed slots, wherein the latch assembly is to control movement of the retractable plate.

8. The at least one print liquid supply interconnect of claim 7, wherein the latch assembly includes:

a wireform coupled to the actuators and the retractable plate to decouple the retractable plate from a base such that the retractable plate may move;

springs to bias the actuators and retractable plate to an extended position;

a plate latch guided in a first latch track to mechanically retain the retractable plate in a retracted position; and a supply latch guided in a second latch track to mechanically retain the print liquid supply in place during operation.

9. The at least one print liquid supply interconnect of claim 1, wherein the at least one needle, electrical interface, two keyed slots and guides extend from the same plane.

10. The at least one print liquid supply interconnect of claim 1, including multiple interconnects coupled via multiple feed hoses to the same printer, wherein respective interconnects are associated with a different color and have keyed slots with different patterns.

11. A print liquid supply comprising:

a reservoir to hold print liquid; and an interface to electrically and fluidly couple the print liquid supply to a printer, wherein the interface includes protrusions to pass through keyed slots in a print liquid supply interconnect and to act upon actuators of the print liquid supply interconnect when passing through corresponding keyed slots.

12. The print liquid supply of claim 11, wherein the interface protrudes from the reservoir.

13. The print liquid supply of claim 11, wherein the reservoir has a maximum capacity of at least 3 liters of liquid.

14. The print liquid supply of claim 11, further including:

an electrical interface extending between one of the protrusions and a liquid output to receive a fluidic needle approximately parallel to a wall of the reservoir from which the interface projects; and contact pads of the electrical interface, which contact pads extend along a line perpendicular to a needle insertion direction of the liquid output.

15. The print liquid supply of claim 11, wherein the interface is a low-profile interface protruding from the reservoir over a distance that is ten times less than a total height of the reservoir.

16. The print liquid supply of claim 11, wherein the interface has a width that is at least three times smaller than a total width of the reservoir.

17. The print liquid supply of claim 11, wherein a cross-section of the protrusion matches the keyed slot.

18. The print liquid supply of claim 11, wherein the print liquid is an additive manufacturing fabrication agent.

19. The print liquid supply of claim 11, wherein the print liquid is ink.

20. The print liquid supply of claim 11, wherein the print liquid supply includes a collapsible reservoir disposed in a container.

21. The print liquid supply of claim 20, wherein the print liquid supply further includes a spout, the spout including:

a sleeve having an opening through which the print liquid pass;

a first flange extending outward from the sleeve to affix the spout to the collapsible reservoir;

a second flange extending outward from the sleeve to sit on a wall of the container; and an angled clamp flange extending outward from the sleeve, the angled clamp flange having an angled surface and a straight surface opposite the angled surface, the angled clamp flange to affix the spout to the container.

22. The print liquid supply of claim 11, wherein the print liquid supply further includes a clamp plate assembly including:

a clamp plate including:

two wedge-shaped forked ends to facilitate clamping a spout to a container in which the reservoir is disposed; and a slot defined by the forked ends to receive and retain the spout; and a back plate approximately orthogonal to the clamp plate.

* * * * *